US008333414B2

(12) United States Patent
Takayanagi et al.

(10) Patent No.: US 8,333,414 B2
(45) Date of Patent: Dec. 18, 2012

(54) VEHICLE DOOR LATCH DEVICE

(75) Inventors: Shinsuke Takayanagi, Aichi-ken (JP); Toshio Machida, Toyota (JP); Jun Ishida, Anjo (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 693 days.

(21) Appl. No.: 12/411,761

(22) Filed: Mar. 26, 2009

(65) Prior Publication Data

US 2009/0267359 A1 Oct. 29, 2009

(30) Foreign Application Priority Data

Apr. 25, 2008 (JP) ..... P2008-115181

(51) Int. Cl.
*E05C 3/06* (2006.01)

(52) U.S. Cl. ..... 292/201; 292/216; 292/DIG. 23

(58) Field of Classification Search ..... 292/201, 292/216, DIG. 23
See application file for complete search history.

(56) References Cited

U.S. PATENT DOCUMENTS

| | | | | |
|---|---|---|---|---|
| 611,564 | A * | 9/1898 | Crump | 81/164 |
| 611,664 | A * | 10/1898 | Ulrich | 534/840 |
| 6,131,337 | A | 10/2000 | Machida | |
| 6,409,233 | B1 * | 6/2002 | Hanaki | 292/144 |
| 6,523,376 | B2 * | 2/2003 | Baukholt et al. | 70/256 |
| 6,698,804 | B2 * | 3/2004 | Shiota et al. | 292/201 |
| 6,805,386 | B2 * | 10/2004 | Ehret et al. | 292/216 |
| 7,559,586 | B2 * | 7/2009 | Fukunaga et al. | 292/216 |
| 7,581,767 | B2 * | 9/2009 | Fujihara | 292/201 |
| 7,926,857 | B2 * | 4/2011 | Akizuki et al. | 292/201 |
| 2001/0005079 | A1 | 6/2001 | Takamura | |
| 2008/0105011 | A1 | 5/2008 | Machida et al. | |

FOREIGN PATENT DOCUMENTS

| | | |
|---|---|---|
| JP | 11-303483 | 11/1999 |
| JP | 2001-098819 A | 4/2001 |
| JP | 2001-182406 | 7/2001 |
| JP | 2005-188047 A | 7/2005 |
| JP | 2007-100324 | 4/2007 |

OTHER PUBLICATIONS

Notification of Reasons for Refusal issued on Sep. 5, 2012 by the Japanese Patent Office in corresponding Japanese Patent Application No. 2008-115181, and English language translation of Notification of Reasons for Refusal.

* cited by examiner

*Primary Examiner* — Carlos Lugo
*Assistant Examiner* — Mark Williams
(74) *Attorney, Agent, or Firm* — Buchanan Ingersoll & Rooney PC

(57) ABSTRACT

A device includes a latch of a door and rotates while engaging with a striker of a vehicle body; a pawl which is rotatable between a latched position to restrict a rotation of the latch and a unlatched position to permit the rotation of the latch; a motor; a release power transmitting unit which transmits a rotational power of the motor to the pawl and rotates the pawl from the latched position to the unlatched position. The device further includes a motor-side rotation board, a relay rotation board, and a pawl-side rotation board, which are connected to be integrally rotatable. The relay rotation board become movable to a power shutoff position by pressing operation though an operating hole formed in a door. In the power shutoff position, connecting between the three boards is released, and the motor-side rotation board and the pawl-side rotation board become individually rotatable.

10 Claims, 25 Drawing Sheets

VEHICLE DOOR LATCH DEVICE

CROSS-REFERENCE TO RELATED APPLICATION

This application is based on and claims priority under 35 U.S.C. §119 with respect to Japanese Patent Application No. 2008-115181, filed on Apr. 25, 2008, the entire content of which is incorporated herein by reference.

TECHNICAL FIELD

The present invention relates to a vehicle door latch device including a latch which is attached to a door of a vehicle, and which rotates while engaging with a striker provided in a vehicle body, and a pawl which permits rotation in a locking direction of the latch, and regulates rotation in an unlocking direction of the latch.

BACKGROUND ART

As such a vehicle door latch device, a relate-art vehicle door latch device is configured such that, when a door is brought into a half-closed state, a latch is rotationally driven by a latch driving motor, and the door is brought into a fully closed state. Here, when the door is brought into a fully closed state, a sound-proofing member is pressed between the door and a vehicle body, the latch and a pawl are pressed against each other by the reaction force to be frictionally engaged with each other. The frictional engagement becomes operation resistance when a handle of the door is operated. Thus, the related-art vehicle door latch device is configured such that a release motor rotationally drives the pawl according to the operation of the handle, thereby separating the pawl from the latch (For example, JP-A-2001-98819, paragraphs [0025] and [0028], and FIG. 2).

However, in the related-art vehicle door latch device, in a case where the release motor has abnormally stopped in a state where the pawl is held in the unlatched position where the rotation of the latch is permitted, it becomes difficult to lock the door in a fully closed state.

SUMMARY OF THE INVENTION

According to an aspect of the present invention, there is provided a vehicle door latch device comprising: a latch which is attached to a door of a vehicle and rotates while engaging with a striker provided in a vehicle body; a pawl which is rotatable between a latched position where a rotation of the latch is restricted and a unlatched position where the rotation of the latch is permitted; a pawl biasing member which biases the pawl to the latched position; a motor which starts rotating in response to an operation to a door opening operating portion provided in the door; a release power transmitting unit which transmits a rotational power in one direction of the motor to the pawl and rotates the pawl from the latched position to the unlatched position, wherein the pawl is disposed in the latched position to hold the door in a closed position, and the pawl is rotationally driven from the latched position to the unlatched position by the rotational power of the motor in response to the operation to the door opening operating portion, thereby allowing the door to be opened, a motor-side rotation board, a relay rotation board, and a pawl-side rotation board which are provided in the release power transmitting unit, and which are rotatably supported about a common rotation board rotating pivot; a pivot penetration long hole which is formed only in the relay rotation board among the three rotation boards, which allows the rotation board rotating pivot to pass therethrough, and which allows the relay rotation board to be linearly moved in a direction orthogonal to the rotation board rotating pivot; a first canceling mechanism which in a state where the relay rotation board is arranged in a power transmission position at one end of a linear movable range thereof, connects the motor-side rotation board, the relay rotation board, and the pawl-side rotation board together to be rotatable integrally to one another, thereby allowing the rotational power in one direction of the motor to be transmitted in an order of the motor-side rotation board, the relay rotation board, the pawl-side rotation board and the pawl, and in a state where the relay rotation board is arranged in a power shutoff position at another end of the linear movable range, cancels the connecting, thereby allowing the motor-side rotation board and the pawl-side rotation board to be individually rotatable, and divides the transmission of power from the motor to the pawl, between the motor-side rotation board and the relay rotation board or between the relay rotation board and the pawl-side rotation board; and a cancel operating portion is arranged at a position which faces an operating hole for emergency formed in the door, and which causes the relay rotation board to move to the power shutoff position from the power transmission position by a manual operation to the cancel operating portion when the motor is stopped in a state where the pawl is disposed in the unlatched position.

Therefore, as one of the advantages of the present invention, the invention can provide a vehicle door latch device which can be manually switched to a latched position in a case where a motor for rotationally driving a pawl has stopped in a motor unlatched position.

These and other advantages of the present invention will be discussed in detail with reference to the accompanying drawings.

DESCRIPTION OF THE PREFERRED EMBODIMENTS

First Embodiment

Figure 1:
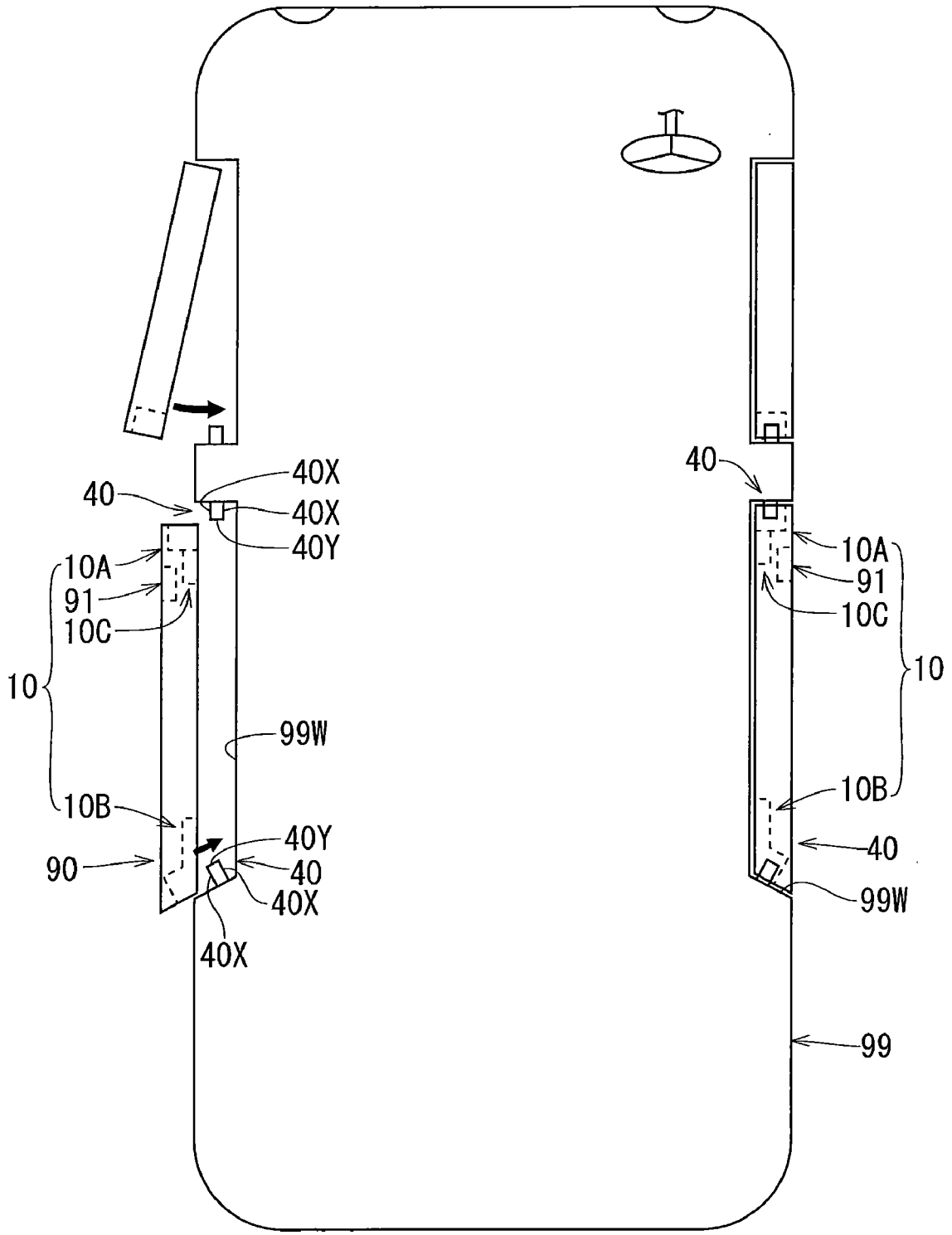
FIG. 1 is a schematic diagram of a vehicle including a vehicle door latch device according to a first embodiment of the invention.

Hereinafter, a first embodiment of the invention will be described with reference to FIGS. 1 to 16. FIG. 1 shows a vehicle which has a slide door 90 with a vehicle door locking system 10. When the slide door 90 is opened from the state where an entrance of a vehicle 99 is closed, the slide door 90 is slid obliquely rearward and then is slid straight rearward to be brought into a fully opened state. The vehicle door locking system 10 includes a closed door locking device 10A, a fully-opened door locking device 10C, a closing device 10B and a remote control device 91. The closed door locking device holds the slide door 90 in a closed state. The fully-opened door locking device 10C holds the slide door in a fully-opened state. The closing device 10B brings the slide door 90 from a half-closed state to a fully-closed state.

Figure 2:
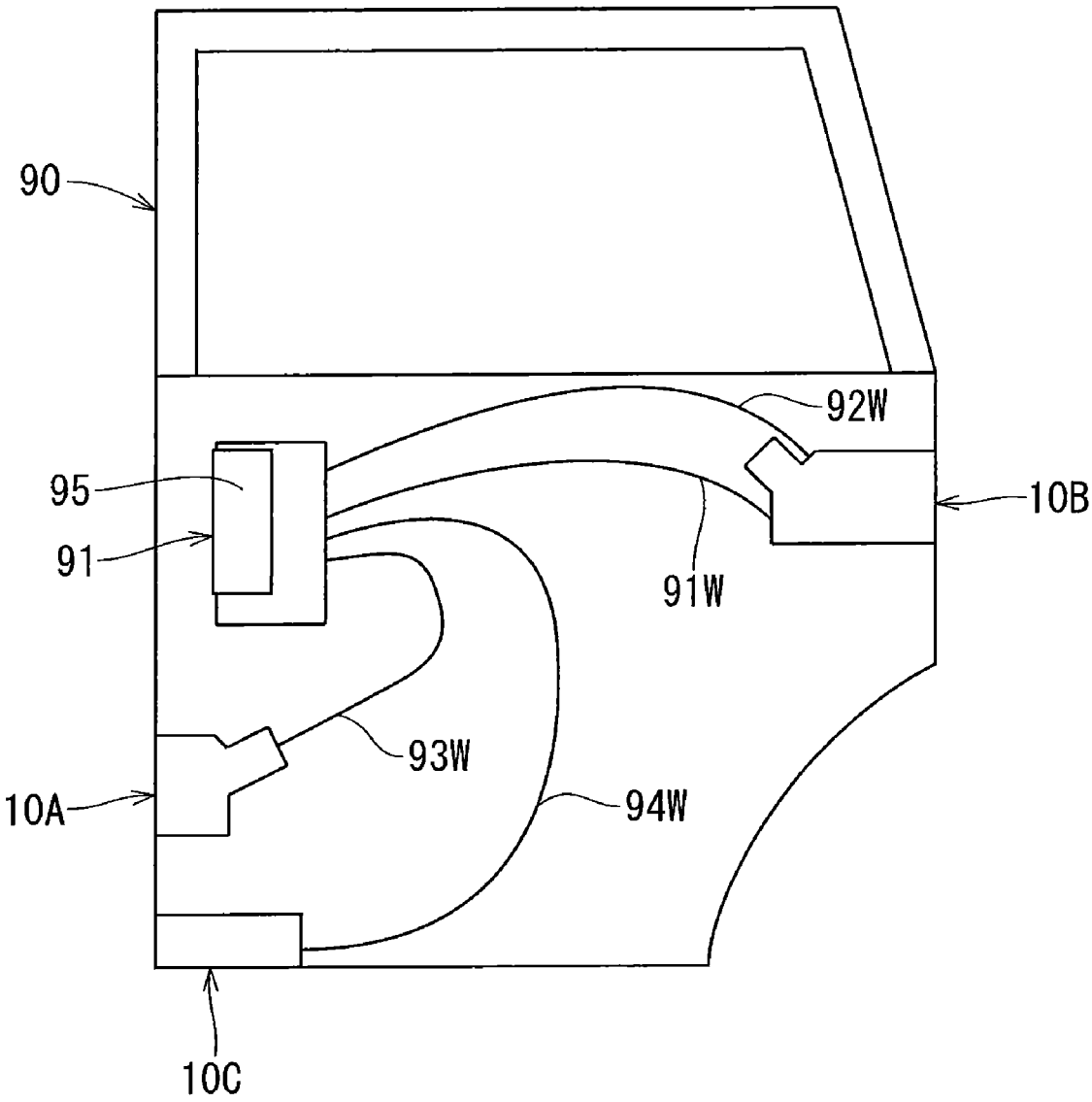
FIG. 2 is a schematic diagram of a slide door including the vehicle door latch device.

As shown in FIG. 2, the closed door locking device 10A and the fully-opened door locking device 10C are arranged at intermediate and lower portions in a height direction at a front end edge of the slide door 90, and the closing device 10B is arranged at an intermediate portion in the height direction at a rear end of the slide door 90. Strikers 40 are provided in three places corresponding to these devices at an inner surface of the door frame 99W (frame of the entrance).

Each striker 40 is formed, for example, by bending a wire rod having a round cross-section, and has a U-shape structure in which a connecting rod 40Y is laid between tips of a pair of legs 40X and 40X. The striker 40 corresponding to the closed door locking device 10A extends horizontally rearward from a front inner surface of the door frame 99W, and the pair of legs 40X and 40X is arranged in inward and outward directions of the door frame 99W. The closed door locking device 10A is adapted so as to engage one leg 40X of these legs which is arranged near the outside. In addition, sectional views of only the portion of the striker 40 which engages with the closed door locking device 10A are shown in FIGS. 3 to 6. Additionally, the striker 40 corresponding to the closing device 10B extends horizontally rearward from the rear inner surface, and the pair of legs 40X and 40X is arranged in inward and outward directions of the door frame 99W. The closing device 10B is adapted so as to engage one leg 40X of these legs which is arranged near the outside. Moreover, although the striker corresponding to the fully-opened door locking device 10C is not shown in FIG. 2, one pair of legs extends horizontally rearward from the front inner surface of the door frame 99W, and is arranged in a vertical direction, and the fully-opened door locking device 10C is adapted so as to engage a connecting rod.

Figure 3:
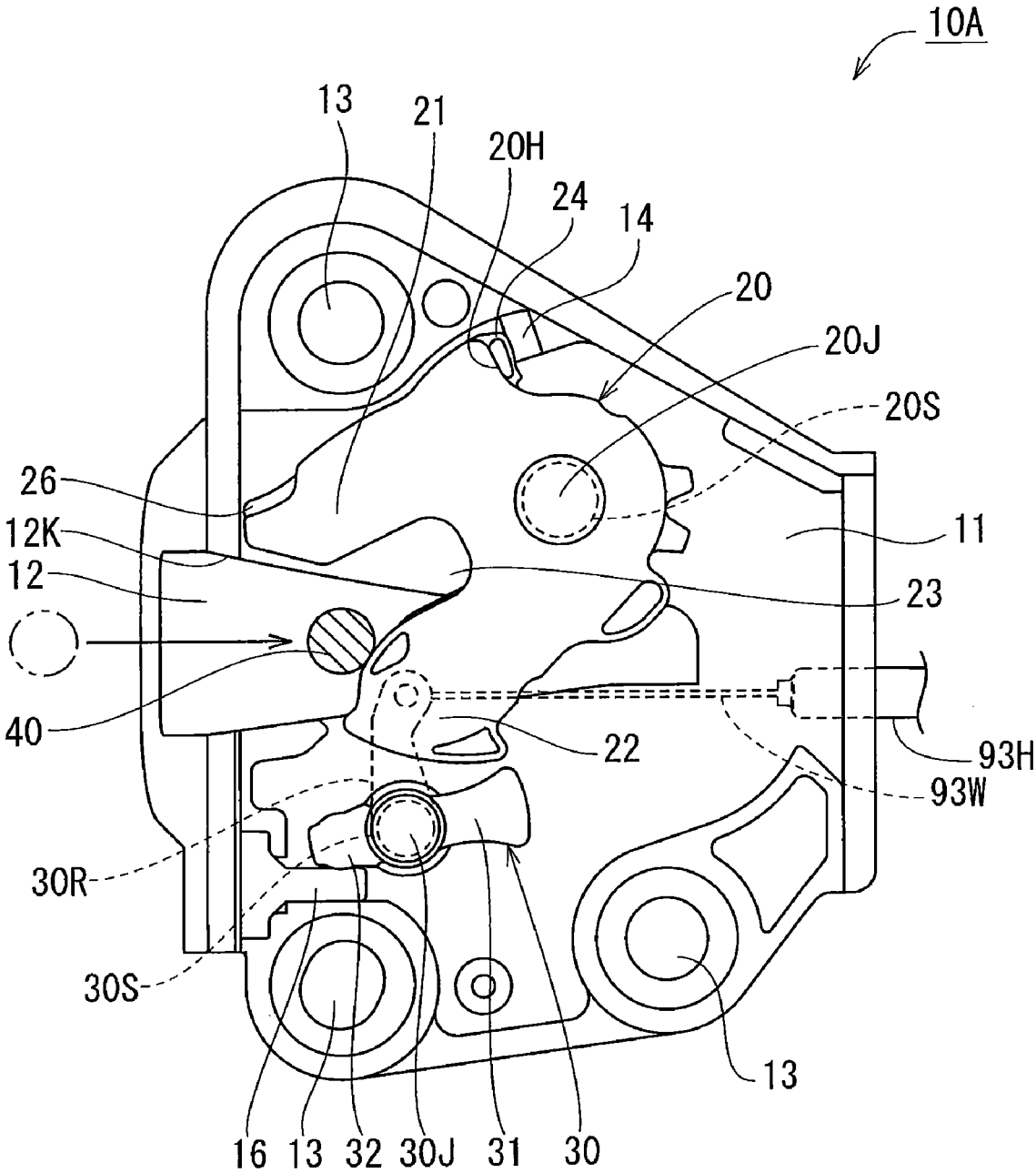
FIG. 3 is a front view of a closed door locking device in an unlatch state.

As shown in FIG. 3, the closed door locking device 10A has a latch 20 and a pawl 30 rotatably assembled to a base board 11. The base board 11 includes a plurality of bolt-fixing holes 13, and is fixed by bolts which are applied to a front end wall of the slide door 90 from inside, and have passed through (have been screwed into) the bolt-fixing holes 13.

The base board 11 is provided with a striker receiving groove 12 which extends horizontally. One end of the striker receiving groove 12 is a striker receiving port 12K which is released toward the inside of a vehicle, and the other end thereof is closed. Additionally, one end wall of the slide door 90 to which the base board 11 is attached is provided with a cutout (not shown) corresponding to a striker receiving groove 12. When the slide door 90 is closed, the striker 40 enters the striker receiving groove 12 from the striker receiving port 12K.

The pawl 30 is rotatably supported at the portion of the base board 11 below the striker receiving groove 12. The pawl 30 has a latch rotation regulating piece 31 and a stopper piece 32 protruding in directions opposite each other from a rotational shaft 30J. Additionally, a torsion spring 30S (refer to FIG. 3) is provided between the pawl 30 and the base board 11, and the pawl 30 is biased in a counterclockwise direction in FIG. 3 by this torsion spring. Typically, the stopper piece 32 contacts and is positioned by a pawl stopper 16 provided in the base board 11.

Additionally, a pawl driving lever 30R is provided on the side opposite the latch rotation regulating piece 31 and the stopper piece 32 apart from the base board 11 in the pawl 30, and the pawl driving lever 30R and the remote control device 91 are connected together by an open cable 93W. Additionally, an intermediate portion of the open cable 93W is covered with a cladding tube 93H. Then, when the open cable 93W is pulled toward the remote control device 91, the pawl 30 rotates in a clockwise direction in FIG. 3, and moves to a release position where the latch rotation regulating piece 31 has retreated from a rotation region of the latch 20 which will be described later.

The latch 20 is rotatably supported at the portion of the base board 11 above the striker receiving groove 12. The latch 20 has a structure in which a metal plate is covered with a resin layer, thereby achieving sound proofing. The latch 20 is provided with a pair of locking claws 21 and 22 parallel to each other, and a portion between the locking claws 21 and 22 becomes a striker receiving portion 23. Additionally, the latch 20 is biased in an unlocking direction (clockwise direction in FIG. 3) relating to the embodiment of the invention by the torsion spring 20S (refer to FIG. 3) provided between the latch and the base board 11. In a state where the slide door 90 is opened, the latch 20 is positioned in a contact position (position shown in FIG. 3) by the contact between a stopper contacting portion 24 provided in the latch 20, and the latch stopper 14 provided in the base board 11.

In an unlatched position, the front locking claw 21 retreats above the striker receiving groove 12, the rear locking claw 22 transverses the striker receiving groove 12, and an opening end of the striker receiving portion 23 faces the striker receiving port 12K of the striker receiving groove 12. The striker 40 which has entered the striker receiving groove 12 is received in the striker receiving portion 23, the striker 40 pushes the rear locking claw 22, thereby rotating the latch 20 in a locking direction (counterclockwise direction in FIG. 3) relating to the embodiment of the invention. Thereby, as shown in FIG. 4, the portion of the striker receiving groove 12 on the side of the striker receiving port 12K from the striker 40 is blocked by the front locking claw 21, and the front locking claw 21 rushes into between the legs 40X and 40X (refer to FIG. 1) of the striker 40, and the latch 20 engages with the striker 40.

Figure 5:
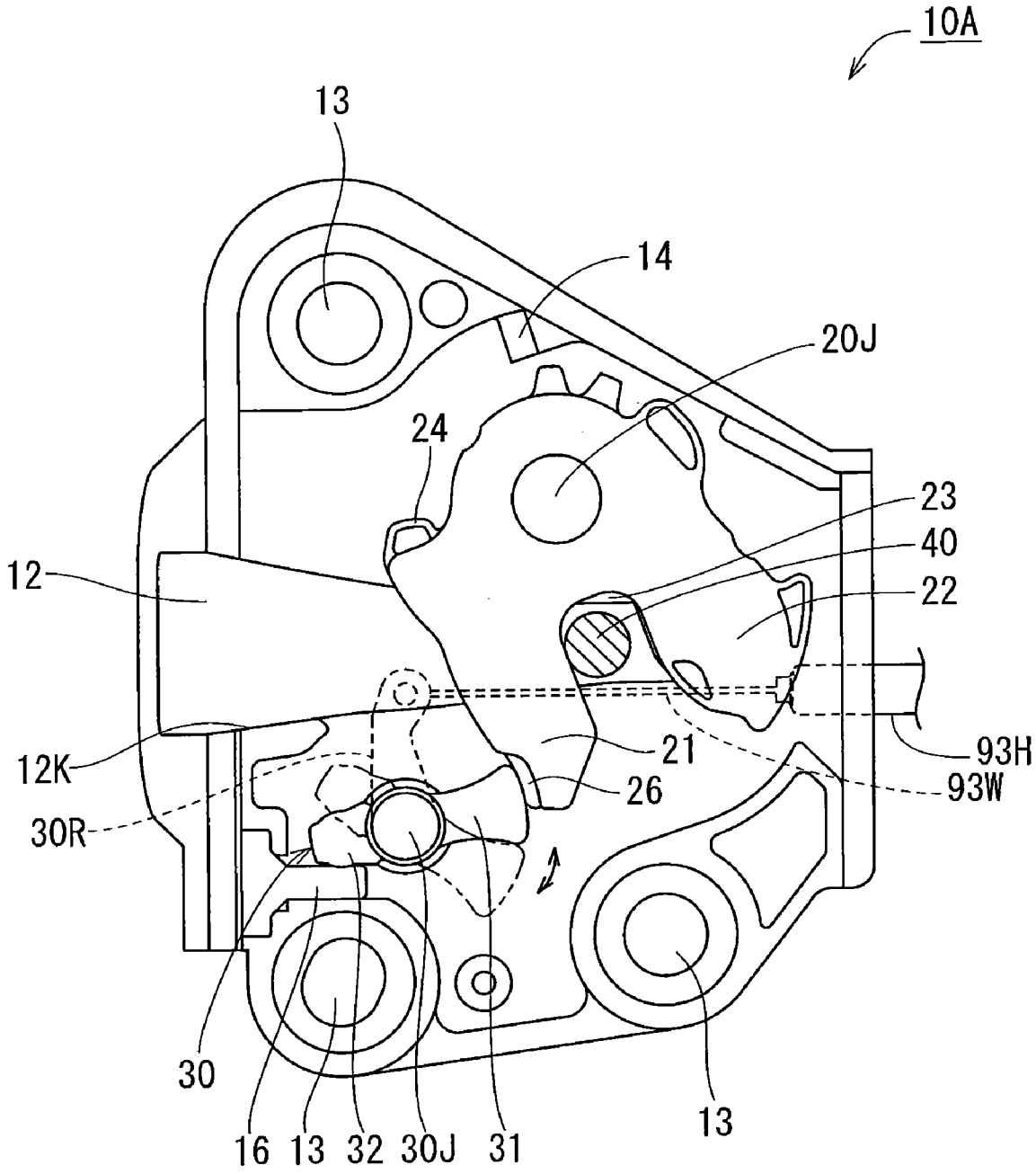
FIG. 5 is a front view of the closed door locking device in a full latch state.
Figure 6:
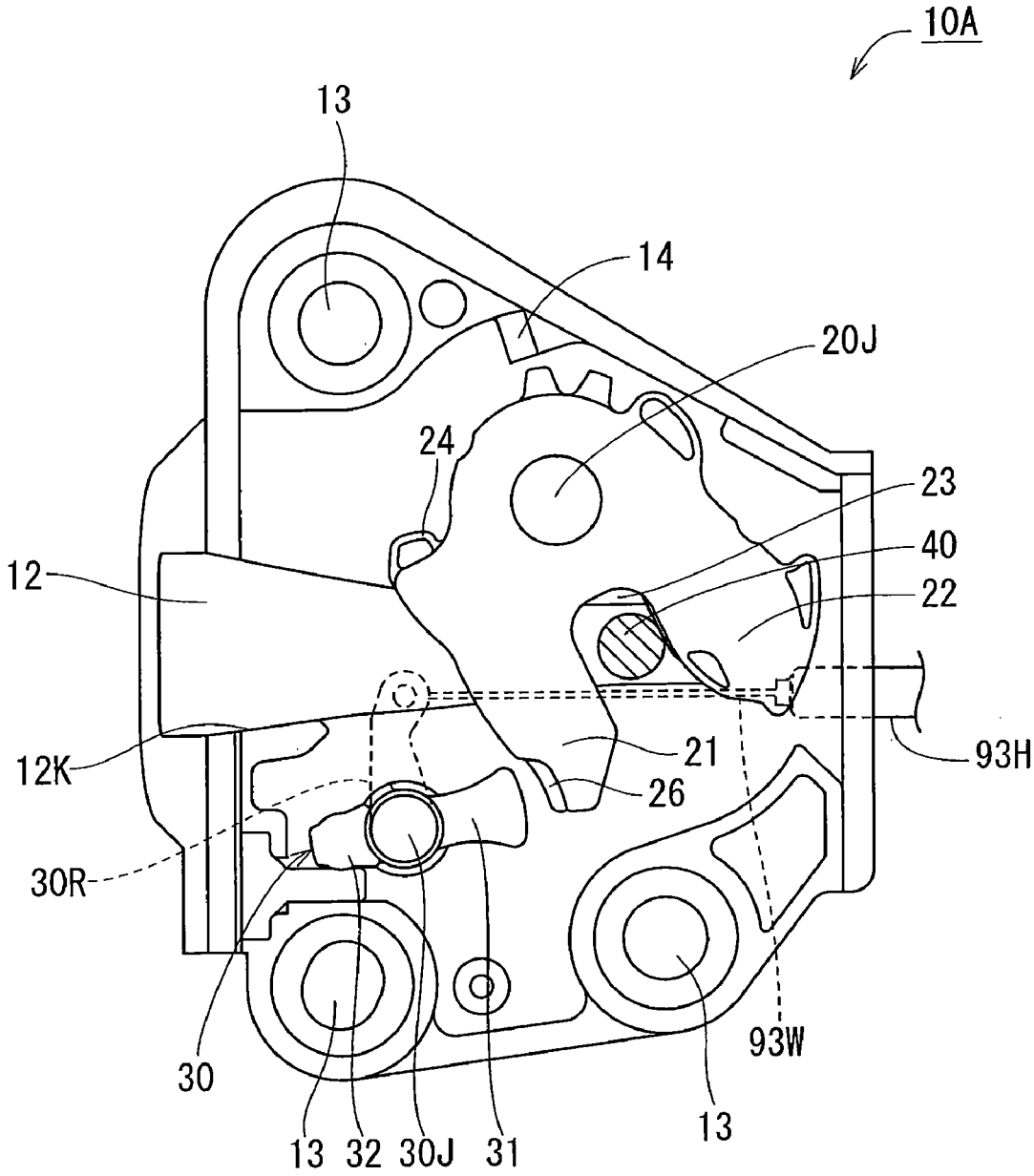
FIG. 6 is a front view of the closed door locking device in an over-latch state.

When the slide door 90 is energized and closed, the slide door 90 is closed in a position where a sound-proofing member (not shown) between the slide door and the door frame 99W is crushed to a maximum extent. At this time, as shown in FIG. 6, the latch 20 passes through the pawl 30 and reaches an over-stroke position slightly separated from the pawl 30. Then, when the slide door 90 is returned by the resilient force of the sound-proofing member, and accordingly, the latch 20 is slightly returned toward the unlatched position from the over-stroke position, as shown in FIG. 5, the locking claw 21 and the latch rotation regulating piece 31 of the pawl 30 contact the front latch 20, and the latch 20 is positioned in a fully latched position. In detail, the pawl contacting portion 26 exposed from the above-mentioned resin layer is provided at a tip portion of the front locking claw 21, and metals which constitute the pawl contacting portion 26 and the latch rotation regulating piece 31 contact each other. Thereby, the rotation of the latch 20 in the unlocking direction is regulated, and the slide door 90 is held in a fully-closed state.

Figure 4:
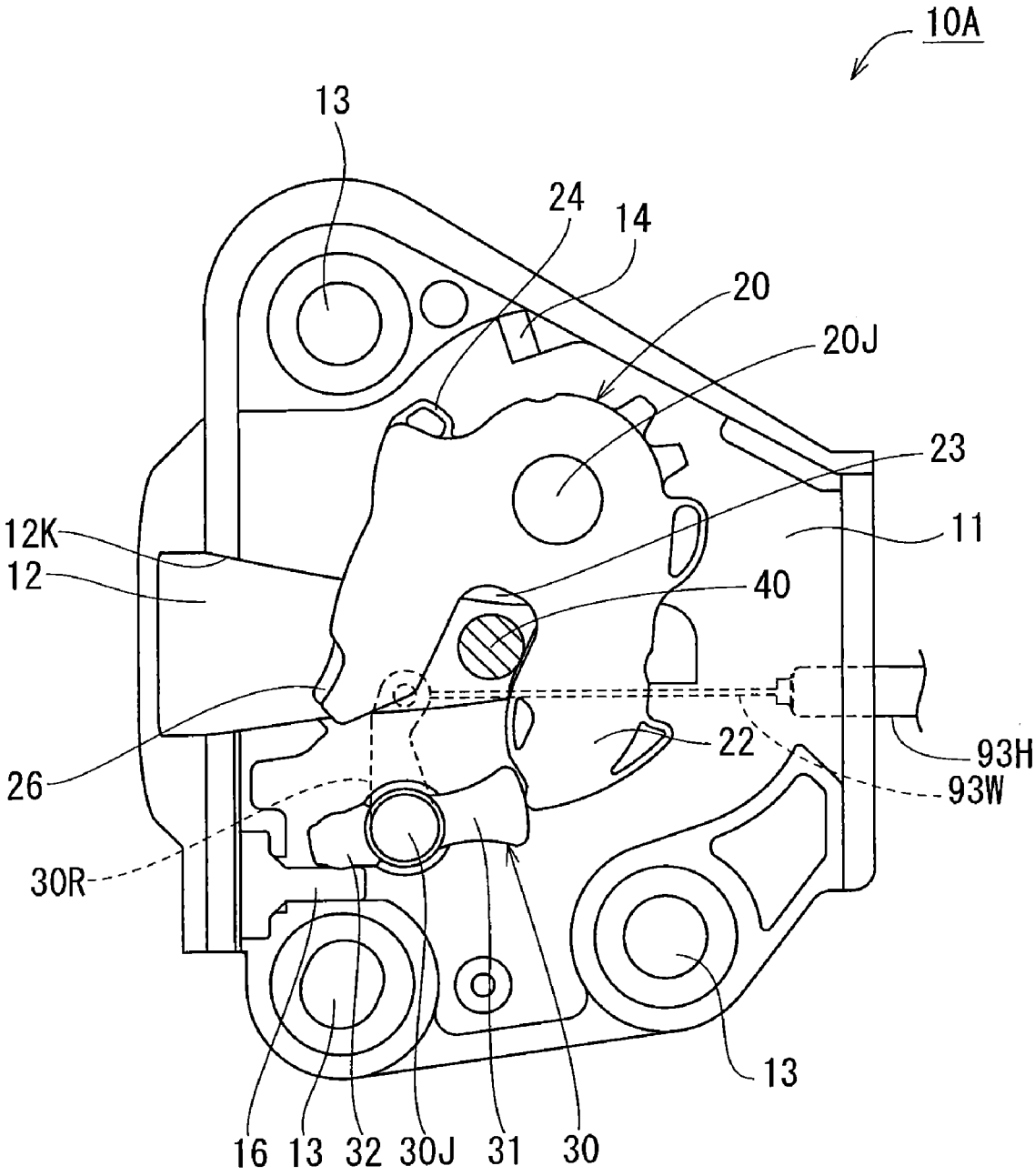
FIG. 4 is a front view of the closed door locking device in a half latch state.

Additionally, since the energy when the slide door 90 is closed is weak, when the slide door 90 is returned by the resilient force of the sound-proofing member in a state where the latch 20 does not reach the over-stroke position or the fully latched position, as shown in FIG. 4, the pawl 30 contacts a tip portion of the rear locking claw 22 the latch 20, and the latch 20 is positioned in a half-latched position, and the slide door 90 is brought into a so-called half-closed state. Description about the configuration of the closed door locking device 10A has been given above. Next, description about the configuration of the closing device 10B (an example of a vehicle door latch device) will be given.

Figure 7:
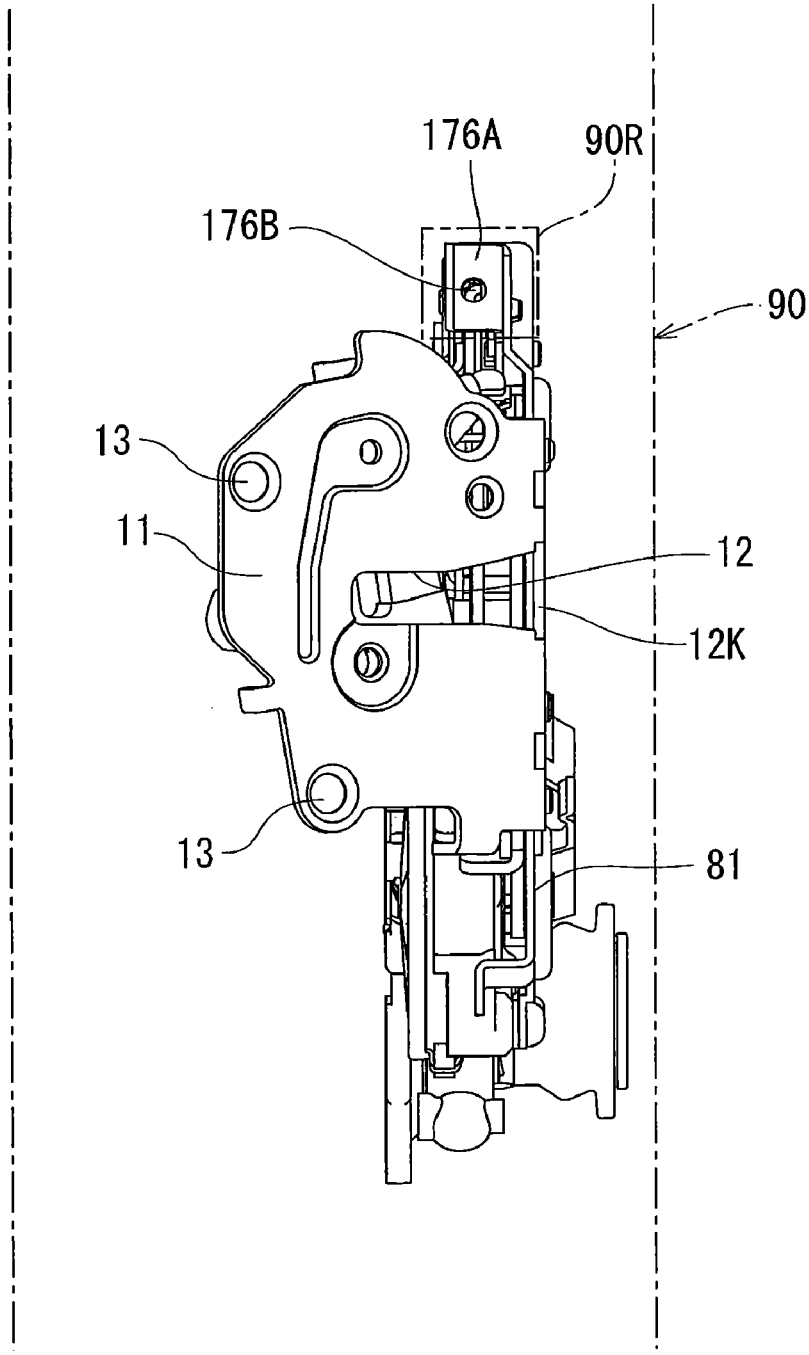
FIG. 7 is a side view of a closing device.
Figure 8:
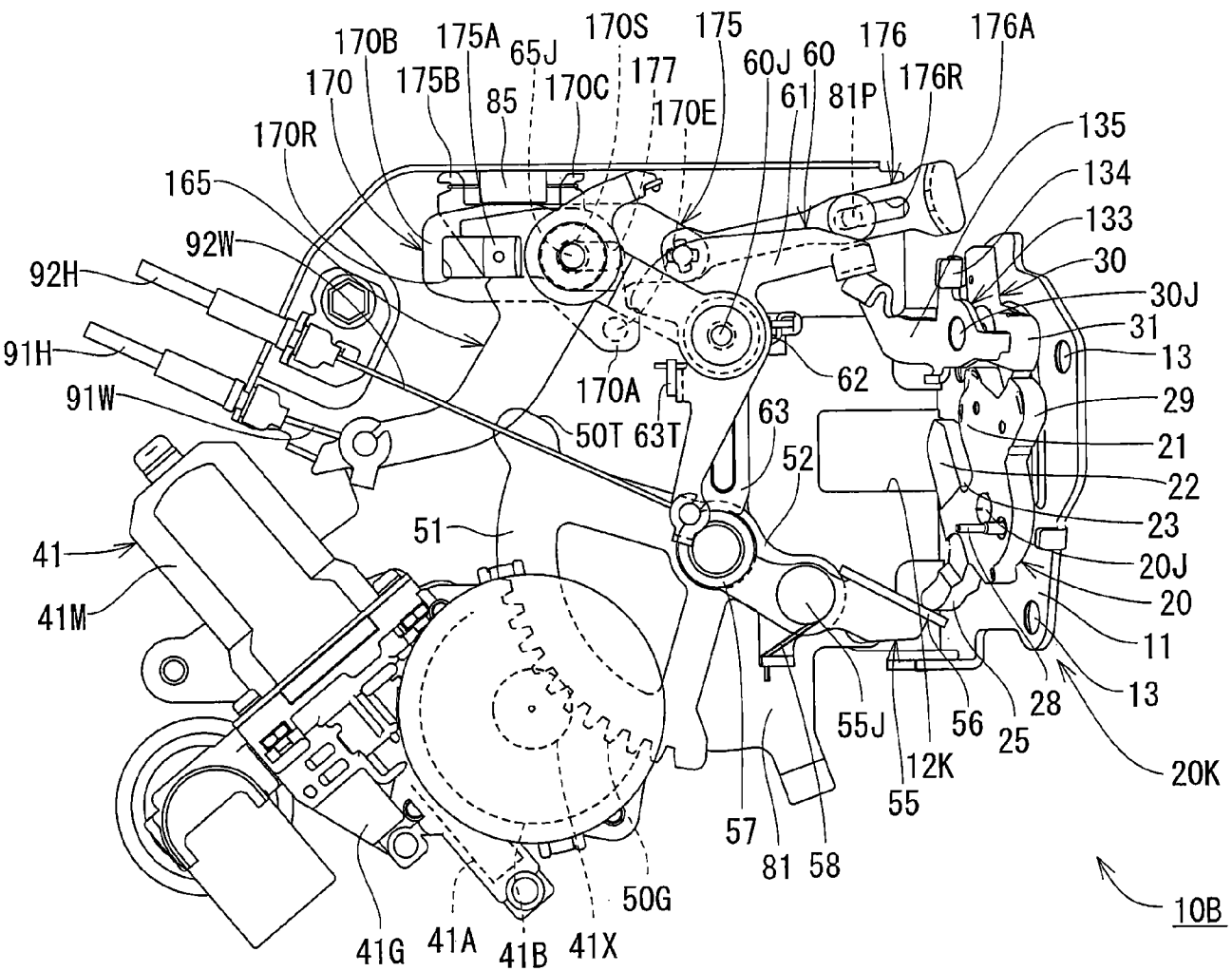
FIG. 8 is a front view of the closing device in a half latch state.
Figure 9:
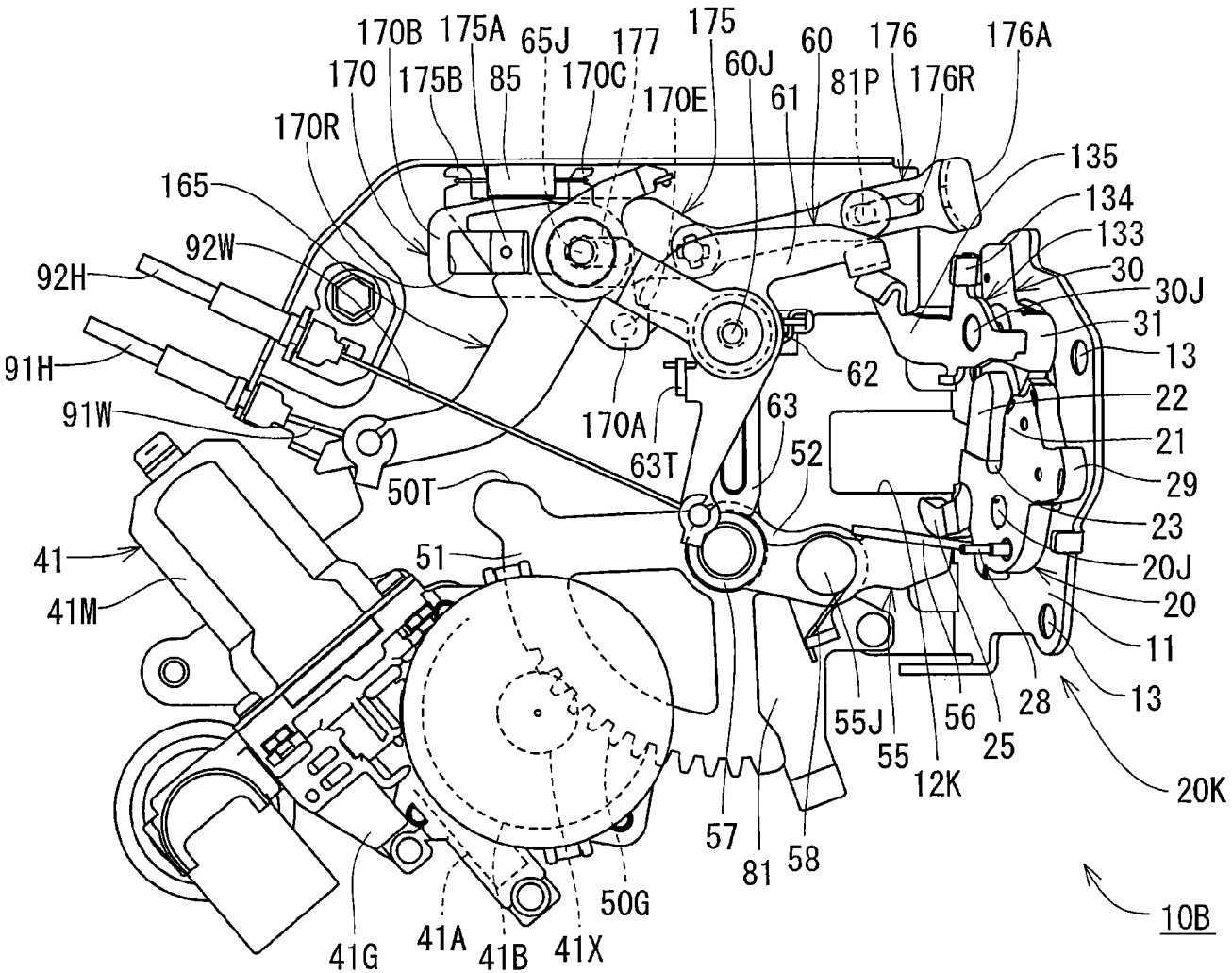
FIG. 9 is a front view of the closing device in a full latch state.

The closing device 10B will be shown in FIGS. 7 to 15. As shown in FIG. 8, the closing device 10B includes a latch and pawl mechanism 20K having the same latch 20 as the closed door locking device 10A, the pawl 30, the striker receiving groove 12, etc. The latch and pawl mechanism 20K differs from the closed door locking device 10A in that the rotational shaft 20J of the latch 20 is arranged below the striker receiving groove 12 (refer to FIG. 7), and the rotational shaft 30J of the pawl 30 is arranged above the striker receiving groove 12, in that the rear locking claw 22 is provided with a latch driving lever 25, and in that the front locking claw 22 is provided with a half latch locking protrusion 29 and a position-detecting pin 28, etc. Hereinafter, the same components between the closing device 10B and the closed door locking device 10A will be denoted by the same reference numerals, and duplicate description thereof will be omitted, and only different components will be described.

As shown in FIGS. 7 and 8, the base board 11 of the closing device 10B is obtained by bending sheet metal at an obtuse angle, and has the striker receiving port 12K at a corner thereof. A mechanism plate 81 is connected with a tip portion of the base board 11 on one side from the corner in an overlapping state, and the latch and pawl mechanism 20K is provided as shown in FIG. 8 on the inner surface on the other side from the corner. Additionally, the latch 20 of the latch and pawl mechanism 20K is covered with a latch pawl cover which is not shown.

As shown in FIG. 8, the latch 20 is provided with the latch driving lever 25, the half latch locking protrusion 29, and the position-detecting pin 28. The latch driving lever 25 and the half latch locking protrusion 29 extend in a direction orthogonal to an axial direction of the rotational shaft 20J of the latch 20 and opposite each other. The latch driving lever 25 is directed obliquely downward in a state where the pawl 30 contacts the half latch locking protrusion 29 of the latch 20 and the latch 20 is located in the half-latched position (refer to FIG. 8). When the latch driving lever 25 is pushed up by a seesaw-type rotation board 55 (an example of a seesaw-type rotary part) which will be described later in this state, the latch 20 rotates in a locking direction in the engagement with the striker 40 is deepened, and moves to the fully latched position (refer to FIG. 9) where the pawl 30 has contacted the tip portion of the front locking claw 22. Additionally, the position detecting pin 28 is arranged in the position of the latch 20 shifted downward from the rotational shaft 20J, and extends in a direction parallel to the axial direction of the rotational shaft 20J and apart from the base board 11. Additionally, the tip portion of the position-detecting pin 28 is connected with a latched position detecting sensor (not shown) through the latch pawl cover. This latched position detecting sensor detects whether or not the latch 20 is arranged in any position of the half-latched position (refer to FIG. 8), the fully latched position (refer to FIG. 9), and the unlatched position (refer to FIG. 11).

The rotational shaft 30J of the pawl 30 extends in a direction apart from the base board 11, and the tip portion thereof passes through the latch pawl cover (not shown). Additionally, the pawl driving lever 133 projects laterally from the tip portion of the rotational shaft 30J. The pawl driving lever 133 is divided into a stopper piece 134 and a pushed down piece 135. As the stopper piece 134 contacts a stopper (not shown) provided in the latch pawl cover, the pawl 30 is positioned in a position where it can regulate the rotation of the latch 20. Additionally, the pushed down piece 135 can be pushed down by a push-down piece 61 of an opening lever 60 which will be described later. As the pushed down piece 135 is pushed down, the latch rotation regulating piece 31 of the pawl 30 moves to the release position (an example of an unlatched position) where it has retreated from the region of rotation of the latch 20, and thereby, the regulation of rotation of the latch 20 is released.

The component parts of the release power transmitting unit and a closing power transmitting unit according to the embodiment of the invention are attached to the mechanism plate 81. Specifically, the component parts are as follows. An active lever 50 (an example of an active rotation board) is rotatably supported at a position near a lower end of the mechanism plate 81. A fan-shaped rotary plate 51 is provided on the side opposite the latch and pawl mechanism 20K with a rotational shaft 50J therebetween in the active lever 50, and a gear 50G is formed at an outer peripheral edge of the fan-shaped rotary plate 51. Additionally, the active lever 50 is provided with a rotation-supporting protruding piece 52 which protrudes toward the latch and pawl mechanism 20K from the rotational shaft 50J, and the seesaw-type rotation board 55 is rotatably supported at a tip portion of the rotation-supporting protruding piece 52.

The seesaw-type rotation board 55 has a seesaw structure in which a rotation piece projects toward both sides of the rotational shaft 55J, and a push-up wall 56 is bent and raised toward the side opposite the mechanism plate 81 from an upper edge of the rotation board. The push-up wall 56 extends from the position of the seesaw-type rotation boards 55 above the rotational shaft 55J to a tip portion on the side of the latch and pawl mechanism 20K, and is adapted to be able to contact the latch driving lever 25 from below. Additionally, the seesaw-type rotation board 55 is biased by a torsion coil spring 58 shown in FIG. 8 in a direction (clockwise direction in FIG. 8) in which the push-up wall 56 separates from the latch driving lever 25.

An contacting roller 57 is attached to the end of the seesaw-type rotation boards 55 opposite the latch and pawl mechanism 20K, and a positioning lever 63 (an example of positioning movable member) which will be described later strikes the contacting roller 57 from above. A "second canceling mechanism" according the embodiment of the invention is constituted by the active lever 50, the seesaw-type rotation board 55, and the positioning lever 63. When the active lever 50 rotates in the counterclockwise direction of FIG. 8 in a state where the contacting roller 57 is positioned by the positioning lever 63, the rotational shaft 55J of the seesaw-type rotation board 55 moves up, and the push-up wall 56 at a tip portion of the seesaw-type rotation board 55 pushes up the latch driving lever 25. Additionally, when the positioning lever 63 moves to a position apart from the contacting roller 57, the seesaw-type rotation board 55 becomes rotatable with respect to the active lever 50, and the transmission of power from the active lever 50 to the seesaw-type rotation board 55 is shut off, so that the latch driving lever 25 is not allowed to be pushed up by the push-up wall 56 of the seesaw-type rotation board 55.

As shown in FIG. 8, an actuator 41 is provided on the side opposite the latch and pawl mechanism 20K with the active lever 50 therebetween. The actuator 41 is composed of a driving motor 41M (an example of a motor), and a speed reducing mechanism 41G. The speed reducing mechanism 41G has a worm gear 41A and a worm wheel 41B built therein, and an motor output shaft of the driving motor 41M is connected with the worm gear 41A. A small gear 41X (refer to FIG. 8) integrally provided in the worm wheel 41B engages with a gear 50G of the fan-shaped rotary plate 51. Thereby, the active lever 50 can be rotated in an arbitrary direction of the clockwise direction and the counterclockwise direction by the driving motor 41M.

As shown in FIG. 8, the positioning lever 63 and the opening lever 60 are supported at the portion of the mechanism plate 81 above the rotational shaft 50J of the active lever 50 so as to be rotatable about a common rotational shaft 60J. One end of the open cable 92W is connected with the tip of the part the opening lever 60 which extends downward from the rotational shaft 60J, and the other end of the open cable 92W is connected with the remote control device 91 (refer to FIG. 16). Additionally, an intermediate portion of the open cable 92W is covered with a cladding tube 92H.

The push-down piece 61 projects toward the pawl 30 from an upper end of the opening lever 60. When the open cable 92W is pulled toward the remote control device 91, the opening lever 60 rotates, and the push-down piece 61 pushes down the pawl driving lever 133 (pushed down piece 135), and thereby, as mentioned above, the pawl 30 moves to the release position, and the restriction on rotation of the latch 20 by the pawl 30 is released. In addition, the opening lever 60 is biased by the torsion coil spring 62 provided between the opening lever and the mechanism plates 81 in the direction (the counterclockwise direction in FIG. 8) in which the push-down piece 61 separates from the pushed down piece 135.

The positioning lever 63 is provided so as to overlap the opening lever 60, and an interlocking contacting piece 63T which rises from a side edge of the positioning lever 63 faces one side edge of the opening lever 60 from the side. When the open cable 92W is pulled toward the remote control device 91 and an opening lever 60 rotates, the interlocking contacting piece 63T is pushed by the opening lever 60, and the positioning lever 63 also rotates, and separates from contacting roller 57. Thereby, as mentioned above, the transmission of power from the active lever 50 to the seesaw-type rotation board 55 is shut off, so that the latch driving lever 25 is not allowed to be pushed up by the push-up wall 56 of the seesaw-type rotation board 55. In this embodiment, the position where the positioning lever 63 has contacted the contacting roller 57 corresponds to a "seesaw contact position" relating to the "positioning movable member", and the position where the positioning lever 63 has separated from the contacting roller 57 corresponds to a "seesaw release position" relating the "positioning movable member".

Figure 15A:
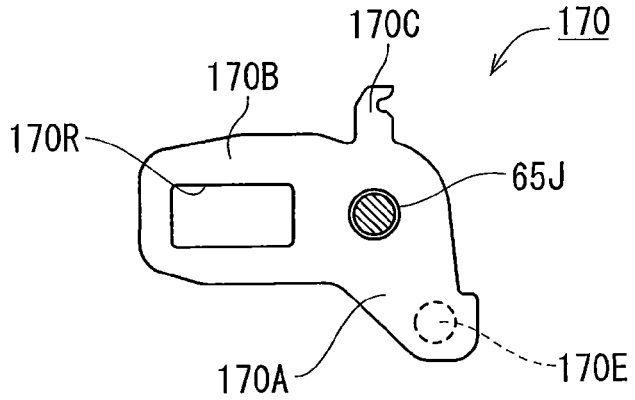
FIGS. 15A to 15C are front views of component parts of a first canceling mechanism.

A release input board 170 (an example of a motor-side rotation board), a slide rotation board 175 (an example of a relay rotation board), and a releasing lever 165 (an example of a pawl-side rotation board) are supported above the opening lever 60 so as to be rotatable about a common rotational shaft 65J (an example of a rotation board rotating pivot), and constitutes a "first canceling mechanism" according to the embodiment of the invention. The release input board 170, as shown in FIG. 15A, has a first rotation piece 170A which extends downward from the rotational shaft 65J, and a second rotation piece 170B which extends in a transverse direction. A contacting boss 170E protrudes toward the mechanism plate 81 from the tip portion of the first rotation piece 170A. The second rotation piece 170B is formed with a sideways long rectangular protrusion engaging hole 170R (an example of a protrusion engaging groove). Additionally, the release input board 170 includes a spring locking hook 170C which protrudes upward.

When the active lever 50 is rotated in a clockwise direction by the driving motor 41M, the pressing portion 50T provided in the active lever 50 contacts the contacting boss 170E of the first rotation piece 170A, and the release input board 170 rotates in a counterclockwise direction of FIG. 8 against the biasing force of the torsion spring 170S (an example of a motor-side rotation board biasing member).

Figure 15B:
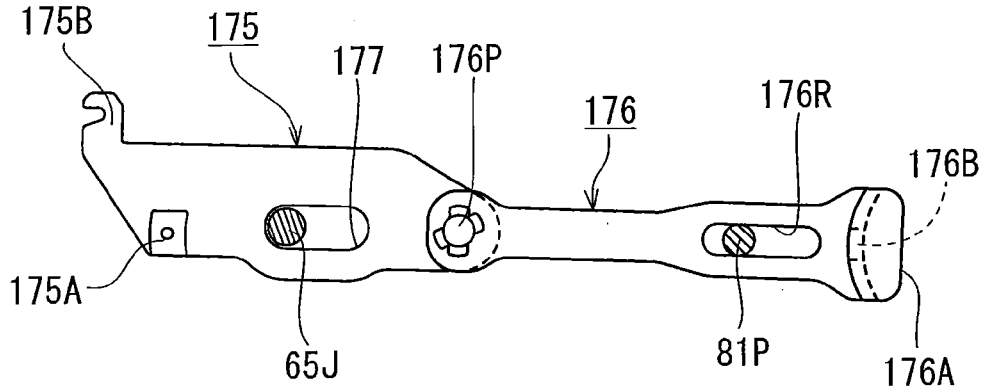

The slide rotation board 175 is arranged between the release input board 170 and the mechanism plate 81. Additionally, the slide rotation board 175 extends in a longitudinal direction of the second rotation piece 170B in the release input board 170. As shown in FIG. 15B, the slide rotation board 175 is formed with a long hole 177 (an example of a pivot penetration long hole) which extends in the longitudinal direction, and the rotational shaft 65J passes through the long hole 177. Additionally, the slide rotation board 175 has a spring locking hook 175B protruding from its tip portion, and this spring locking hook and a spring locking hook 170C provided in the release input board 170 are connected together by a spring 85 (an example of a relay rotation board biasing member) (refer to FIG. 8).

From the tip portion of the release input board 170, a connecting rotation protrusion 175A protrudes toward the side away from the mechanism plate 81. The connecting rotation protrusion 175A is formed in a prismatic shape of a width approximately equal to the width of the protrusion engaging hole 170R of the release input board 170, and is also received within a protrusion receiving groove 165R (an example of a protrusion receiving recess) of the releasing lever 165, which will be described later, through its protrusion engaging hole 170R.

The slide rotation board 175 is biased into a state where the rotational shaft 65J has contacted the tip side of the long hole 177 by the spring 85, and movement of the slide rotation board 175 in a direction orthogonal to the axial direction of the rotational shaft 65J is regulated. Additionally, when an external force is applied in the longitudinal direction of the slide rotation board 175, the slide rotation board 175 can be made to slide against the biasing force of the spring 85. Here, the position of the slide rotation board 175 when the rotational shaft 65J is arranged at a tip portion (left end of FIG. 15B) of the long hole 177, that is, the connecting rotation protrusion 175A is arranged at the end of the protrusion engaging hole 170R on the side of the rotational shaft 65J corresponds to an example of a power transmission position relating to the relay rotation board. The position of slide rotation board 175 when the rotational shaft 65J is arranged at a base end (right end of FIG. 15B) of the long hole 177, that is, the connecting rotation protrusion 175A is arranged at the end of the protrusion engaging hole 170R apart from the rotational shaft 65J corresponds to an example of a power shutoff position relating to the relay rotation board.

A cancel operating bar 176 (an example of an operating force transmitting member) for linearly moving the slide rotation board 175 from the power transmission position to the power shutoff position is connected with the slide rotation board 175. The cancel operating bar 176 is rotatably connected with the base end of the slide rotation board opposite the connecting rotation protrusion 175A with the long hole 177 therebetween by a connecting pin 176P. The cancel operating bar 176 extends substantially parallel to the longitudinal direction of the slide rotation board 175, and the base end thereof, as shown in FIG. 8, is exposed to the side from an outer edge of the mechanism plate 81.

A portion nearer the base end than a longitudinal central portion of the cancel operating bar 176 is formed with a long hole 176R which extends in the longitudinal direction, and a pin 81P which rises from the mechanism plate 81 passes through the long hole 176R. Thereby, the cancel operating bar 176 is made linearly movable in the longitudinal direction, and is made rotatable with the pin 81P as a fulcrum. The pin 81P is an example of an operating portion rotating pivot.

The base end of the cancel operating bar 176 is provided with a pressing and operating piece 176A (an example of a cancel operating portion). The pressing and operating piece 176A is formed in the shape of a crank which protrudes toward the side (near side of a sheet plane of FIG. 15) away from the mechanism plate 81. The pressing and operating piece 176A is arranged so as to face the operating hole 90R (refer to FIG. 7) for emergency formed at a rear end wall of the slide door 90, and is adapted to be able to strike a predetermined tool inserted through the operating hole 90R for emergency. In addition, a wall portion of the pressing and operating piece 176A perpendicular to the mechanism plate 81 is formed in the shape of a concave surface which is bent smoothly in front view seen from the operating hole 90R for emergency. In a case where a tool whose tip is sharpened is used as the predetermined tool, an antislip recess 176B which makes concavo-convex engagement with a tip portion of the tool is formed.

Figure 15C:
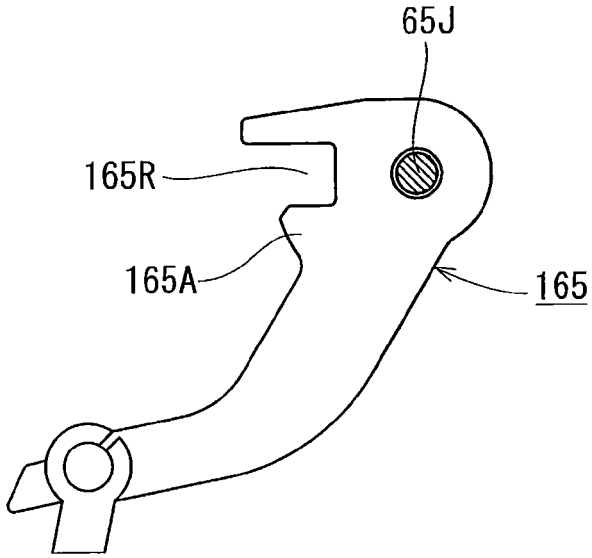

The releasing lever 165, as shown in FIG. 15C, extends obliquely downward from the rotational shaft 65J, and one end of the release cable 91W, as shown in FIG. 8, is connected with a lower end of the releasing lever. The other end of the release cable 91W is connected with the remote control device 91, and an intermediate portion of the release cable 91W is covered with a cladding tube 91H. Here, the releasing lever 165 is biased in the clockwise direction in FIG. 8 by pulling the release cable 91W by a first origin holding spring 98S provided in the remote control device 91 which will be described later.

The portion of the releasing lever 165 from a base end in the vicinity of the rotational shaft 65J to an intermediate portion has a width which is increased in the shape of a fan, and the protrusion receiving groove 165R is formed there. The protrusion receiving groove 165R is formed in the shape of the letter "U" which is opened in a direction (specifically, the side opposite the latch and pawl mechanism 20K) orthogonal to the rotational shaft 65J. When the slide rotation board 175 is arranged in the power transmission position as shown in FIGS. 8 to 11, the connecting rotation protrusion 175A is received in the protrusion receiving groove 165R, and when the slide rotation board 175 is arranged in the power shutoff position as shown in FIG. 12, the connecting rotation protrusion 175A separates laterally of the protrusion receiving groove 165R.

Figure 10:
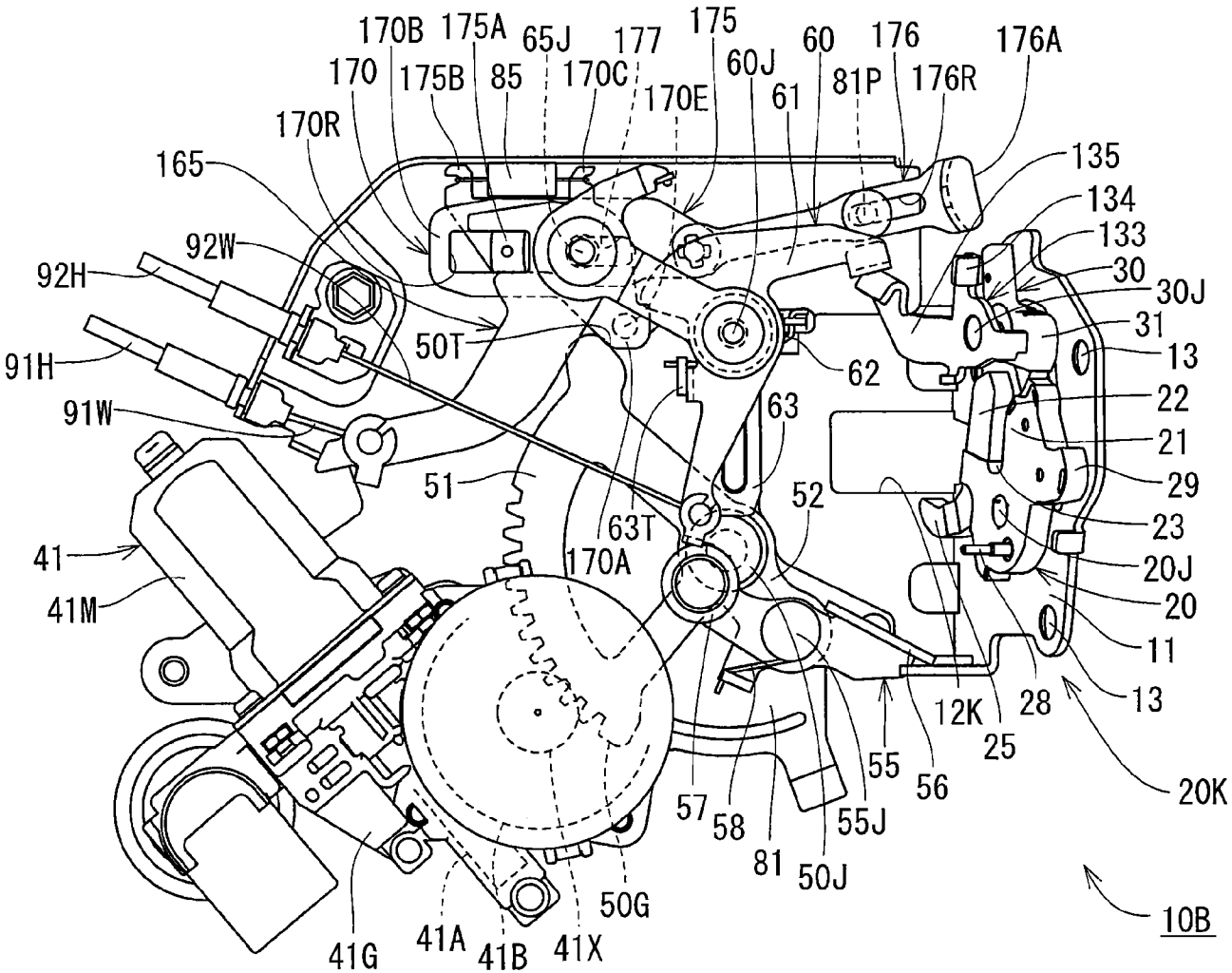
FIG. 10 is a front view of the closing device in a state immediately before contacting on a releasing lever.
Figure 11:
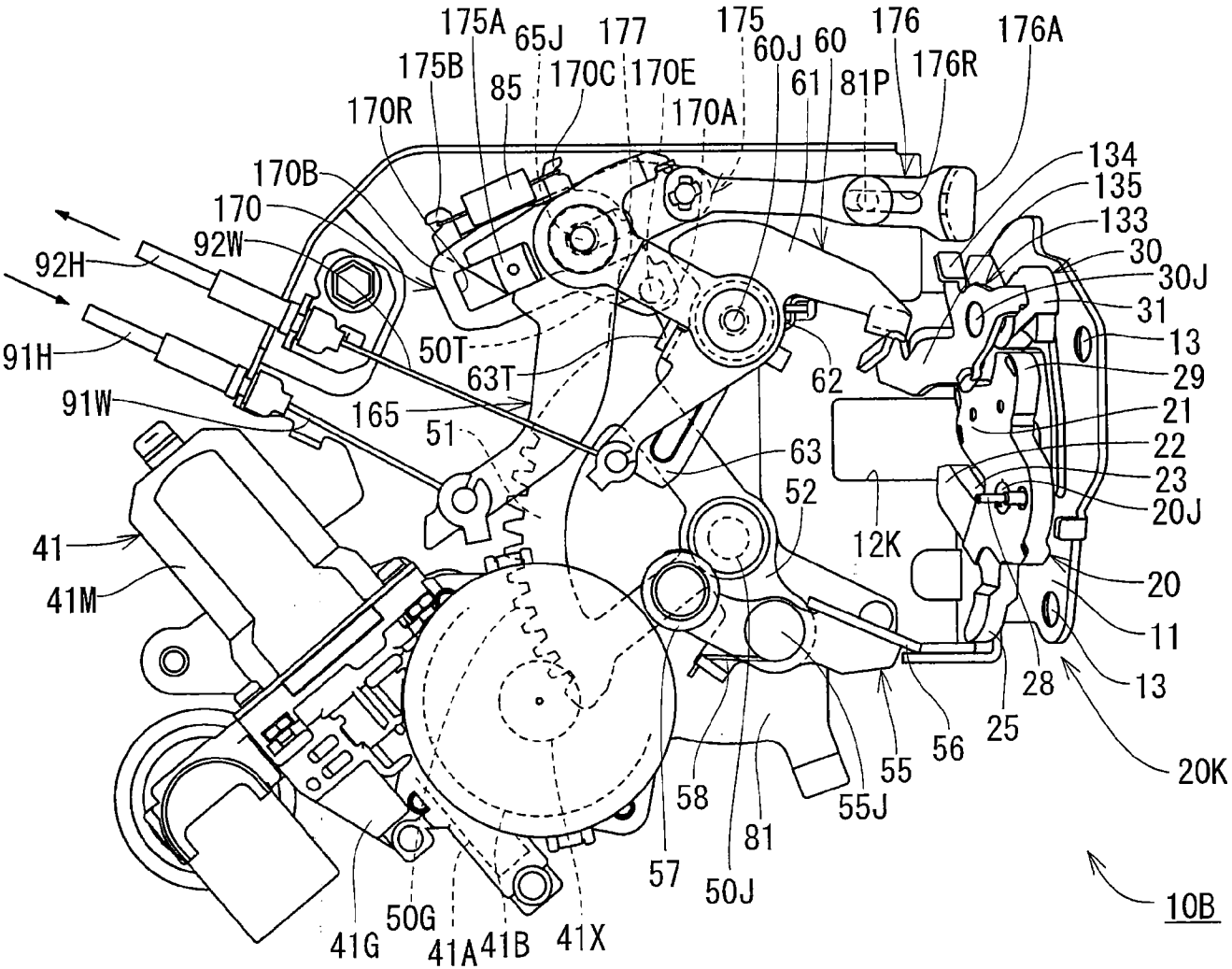
FIG. 11 is a front view of the closing device in a state where a pawl has been moved to a release position by the power of a latch driving motor.

Here, when the release input board 170 rotates under the power from the active lever 50 in the state where the connecting rotation protrusion 175A is received in the protrusion receiving groove 165R, as shown in the change from FIG. 10 to FIG. 11, the slide rotation board 175 and the releasing lever 165 rotate integrally with the release input board 170. This makes it possible to pull the release cable 91W toward the closing device 10B from the remote control device 91.

Figure 12:
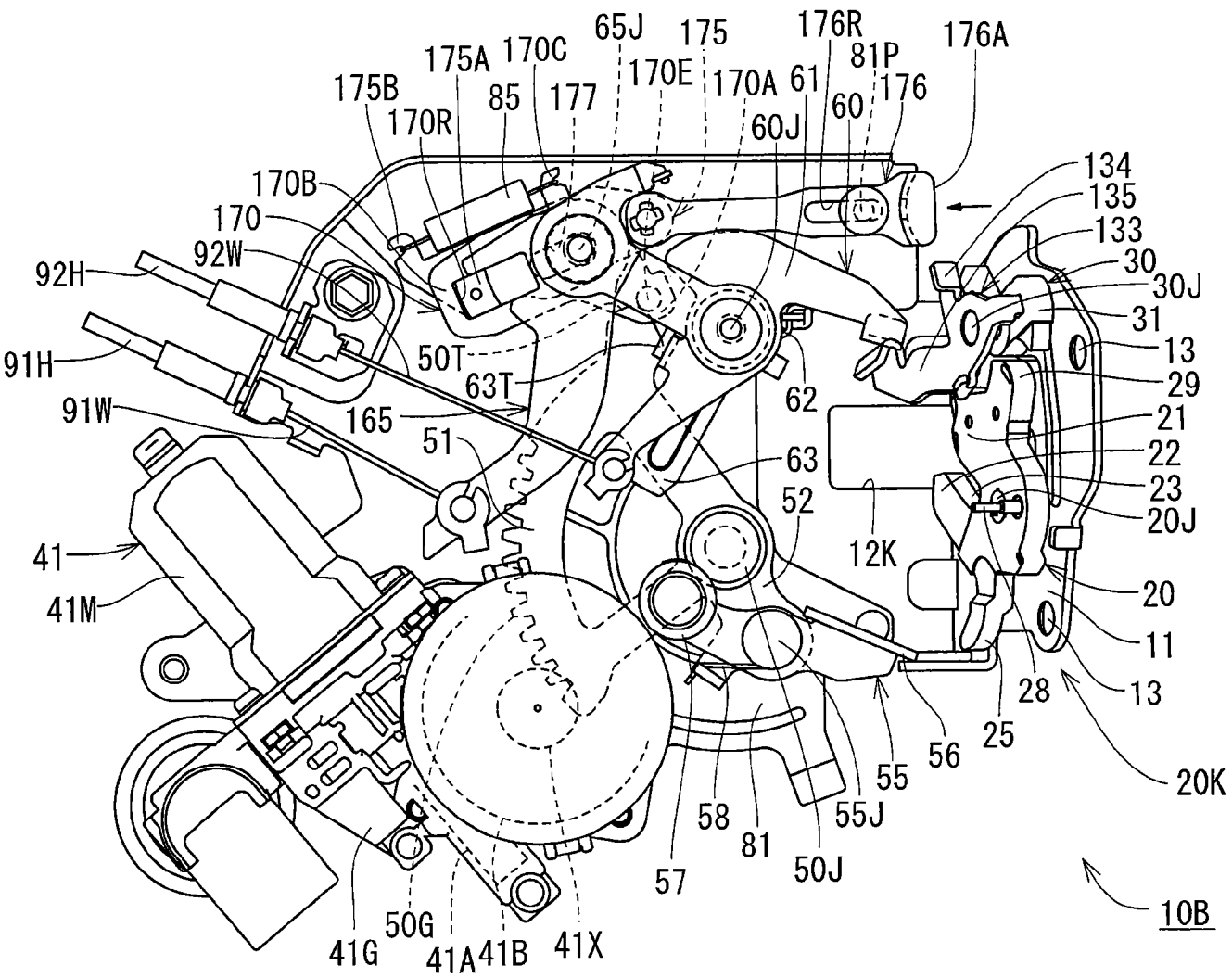
FIG. 12 is a front view of the closing device immediately after a slide rotation board has been moved to a power shutoff position at the time of an abnormal stop of the latch driving motor.
Figure 13:
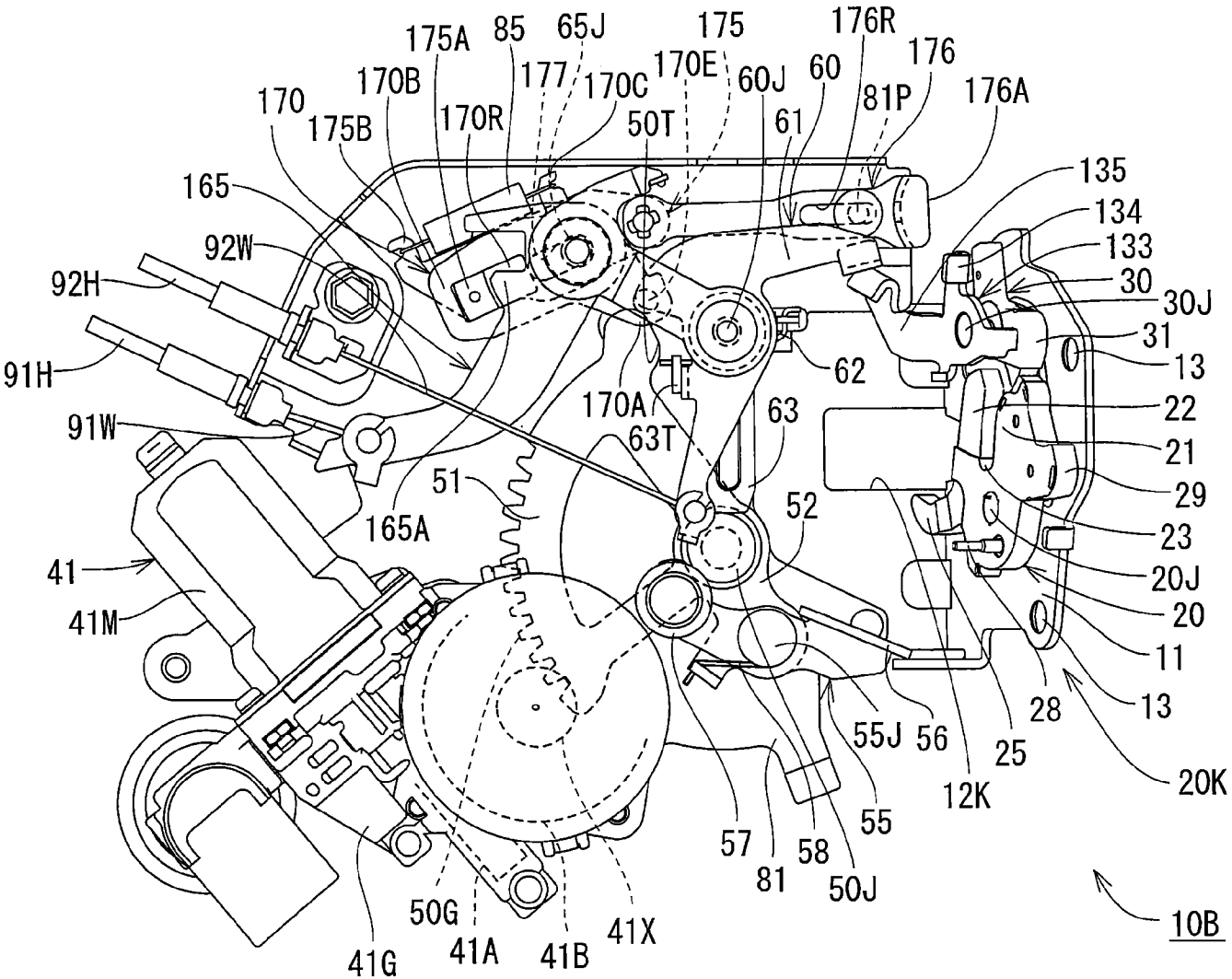
FIG. 13 is a front view of the closing device in a state where the releasing lever has returned to its original position.

Additionally, as shown in the change from FIG. 11 to FIG. 12, when the slide rotation board 175 moves from the power transmission position to the power shutoff position to separate the connecting rotation protrusion 175A laterally of the protrusion receiving groove 165R, as shown in FIG. 13, the releasing lever 165 becomes freely rotatable with respect to the slide rotation board 175. That is, the transmission of power between the connecting rotation protrusion 175A and the releasing lever 165 is shut off.

Although not shown, the fully-opened door locking device 10C has the latch and pawl mechanism which operates like the closed door locking device 10A. The pawl of the fully-opened door locking device 10C is also provided with the pawl driving lever like the closed door locking device 10A, and the pawl driving lever and the remote control device 91 are connected together by the open cable 94W (refer to FIG. 2).

Figure 16:
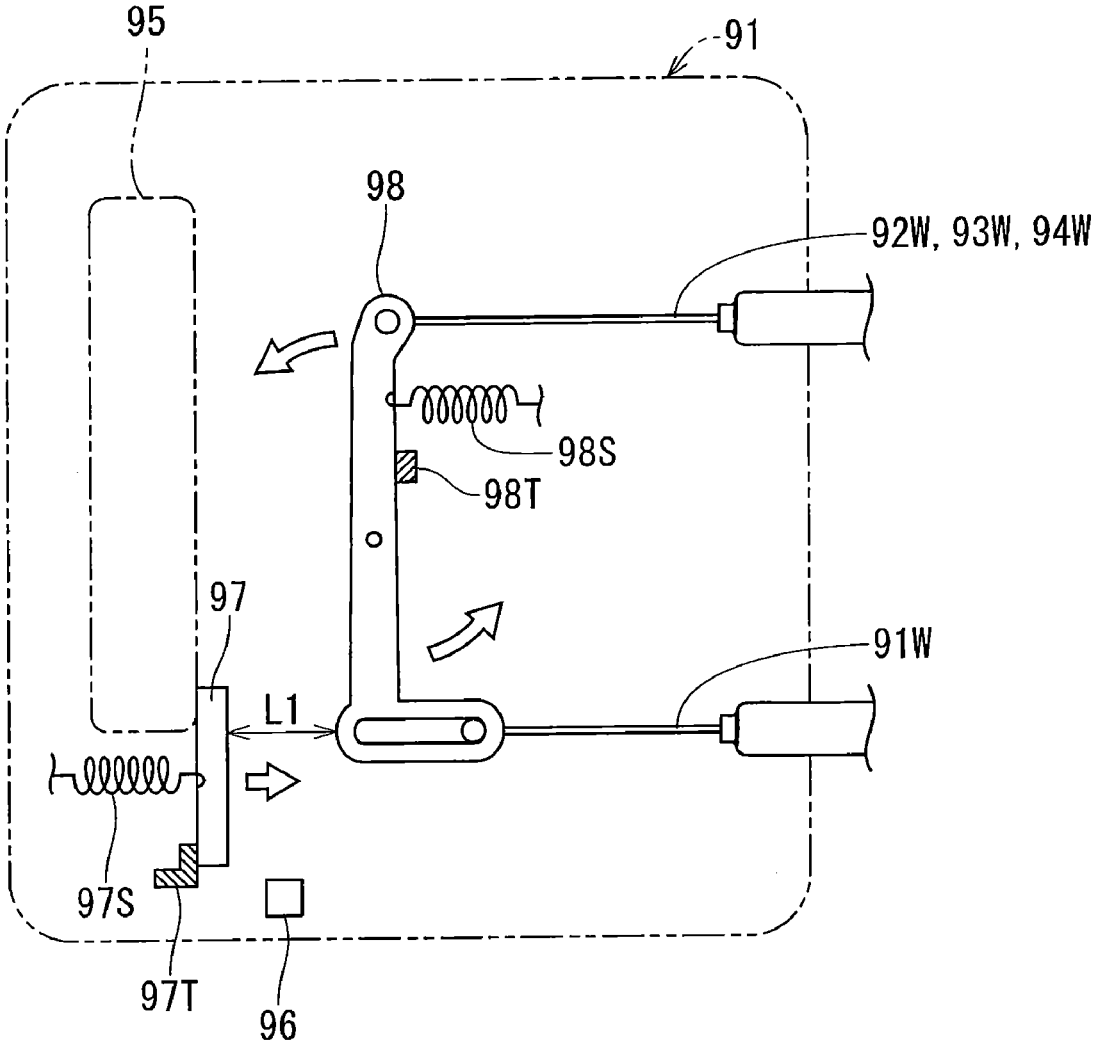
FIG. 16 is a schematic diagram of a remote control device.

As conceptually shown in FIG. 16, the remote control device 91 includes a remote control rotating lever 98 which has the open cables 92W, 93W, and 94W connected with one end thereof. The remote control rotating lever 98 is biased to and positioned in its origin position (position shown in FIG. 16) by the first origin holding spring 98S and a stopper 98T. Additionally, the release cable 91W is connected with the end of the remote control rotating lever 98 opposite the portion thereof, which is connected with the open cables 92W, 93W, and 94W, with a rotation center therebetween. Thereby, when the driving motor 41M is driven to pull the release cable 91W toward the closing device 10B, the remote control rotating lever 98 rotates in the direction (the counterclockwise direction in FIG. 16) away from its origin position, and the open cables 92W, 93W, and 94W are pulled toward the remote control device 91. Thereby, all the pawls 30 of the closed door locking device 10A, the closing device 10B, and the fully-opened door locking device 10C move to their release positions, and the restriction on rotation of all the latches 20 is released at a time.

The remote control device 91 is provided with handles 95 individually provided on inner and outer surfaces of the slide door 90. Each handle 95 is biased to and held in its origin position by a second origin holding spring 97S and a stopper 97T. When the handle 95 is operated to move toward the side away from its origin position against the second origin holding spring 97S, a handle interlocking part 97 connected with the handle 95 passes through a predetermined independent movable region L1 from the origin position, and contacts the remote control rotating lever 98. In this state, when the handle 95 is further moved toward the side away from its origin position, the handle interlocking part 97 pushes and rotates the remote control rotating lever 98. Additionally, the remote control device 91 is provided with a handle operation detecting sensor 96 fro detecting that the handle interlocking part 97 has entered the independent movable region L1 from the origin position. Additionally, a detection signal of the handle operation detecting sensor 96 along with a detection signal of the latched position detecting sensor is fetched into an ECU (not shown) provided in the vehicle body 99. The ECU drives the driving motor 41M as explained in detail below on the basis of these detection signals.

The description about the configuration of this embodiment has been given above. Next, the operational effects of this embodiment by the above configuration will be described. When the slide door 90 is fastened, the respective latches 20 of the closed door locking device 10A and the closing device 10B engage with the corresponding strikers 40, and rotate. At this time, when the slide door 90 is closed by a relatively strong force and the slide door 90 is in a fully closed state, the respective latches 20 of the closed door locking device 10A and the closing device 10B, as shown in FIGS. 5 and 10, rotate to the fully latched positions, the pawls 30 (specifically, latch rotation regulating pieces 31 of the pawls 30) engage the latches 20, and the rotation of the latches 20 in the respective unlocking directions is regulated (prohibited). Thereby, the slide door 90 is held is in a fully closed state.

Additionally when the slide door 90 is closed by a relatively weak force and the slide door is in a half-closed state, the respective latches 20 of the closed door locking device 10A and the closing device 10B, as shown in FIGS. 4 and 8, rotate to the latched positions, the pawls 30 engage the latches 20, the rotation of the respective latches 20 in the unlocking directions is regulated (prohibited), and held in a half-closed state. Then, the latched position detecting sensor of the closing device 10B detects that the latch 20 is located in a half-latched position, and the detection result thereof is fetched into ECU. Then, the ECU makes the motor output shaft of the driving motor 41M provided in the closing device 10B rotate in one direction, thereby rotationally driving the active lever 50 in the counterclockwise direction in FIG. 8. At this time, the positioning lever 63 contacts the contacting roller 57, thereby positioning one end of the seesaw-type rotation board 55, and the rotational shaft 55J of the seesaw-type rotation board 55 is lifted by the active lever 50. Thereby, power is transmitted to the seesaw-type rotation board 55 from the active lever 50, and the other end (specifically, the tip portion of the push-up wall 56 provided in the seesaw-type rotation board 55) of the seesaw-type rotation board 55 pushes up the latch driving lever 25 of the latch 20. Thereby, the latch 20 moves to the fully latched position shown in FIG. 9 from the half-latched position shown in FIG. 8, and the slide door 90 is changed to a fully closed state from a half-closed state and is held in the fully closed state.

Here, when the handle 95 is operated while shifting from a half-closed state to a fully closed state is made, the open cable 92W is pulled toward the remote control device 91, and the positioning lever 63 separates from the contacting roller 57 of the seesaw-type rotation board 55. Thereby, the transmission of power from the active lever 50 to the seesaw-type rotation board 55 is shut off urgently, so that the shifting from a half-closed state to a fully closed state can be cancelled. Since the opening lever 60 is also rotated in conjunction with the handle 95, and the push-down piece 61 of the opening lever 60 pushes down the pawl driving lever 133 of the pawl 30, the pawl 30 of the closing device 10B can move to its release position even if it engages with the latch 20. Additionally, since other open cable 93W is pulled toward the remote control device 91 by the operation of the handle 95, the pawl 30 in the closed door locking device 10A also moves to its release position. This makes it possible to open the slide door 90.

When the slide door 90 is in a fully closed state, the soundproofing member is crushed between the slide door 90 and the door frame 99W, and the respective pawls 30 and respective latches 20 of the closed door locking device 10A and the closing device 10B are brought into frictional engagement by the reaction force of the crushing. Meanwhile, in order to open the slide door 90, it is necessary to move both the pawls 30 of the closed door locking device 10A and the closing device 10B to their release positions against the frictional resistance of the pawls 30 and the latches 20, and in order to both the pawls 30 to their release positions only by manual operation, a large force is required. However, in this embodiment, when the handle 95 is operated, the handle operation detecting sensor 96 detects that the handle 95 has been operated before the frictional resistance between the pawl 30 and the latch 20 is applied to the handle 95, and the ECU receives this detection result, and rotate the motor output shaft of the driving motor 41M in other direction.

Then, the active lever 50 is rotationally driven in the clockwise direction in FIG. 10, and the release input board 170, the slide rotation board 175, and the releasing lever 165 receive the power from the active lever 50, and rotates in the counterclockwise direction in this drawing. Then, as shown in the change from FIG. 10 to FIG. 11, the releasing lever 165 pulls the release cable 91W toward the closing device 10B. Thereby, the remote control rotating lever 98 of the remote control device 91 rotates, and the open cables 92W and 93W are pulled toward the remote control device 91, so that the pawls 30 of the closed door locking device 10A and the closing device 10B can be moved to their release positions by the power of the driving motor 41M, and the slide door 90 can be opened easily.

Additionally, when the slide door 90 is brought into an opened state, the latch 20 and the striker 40 (not shown) of the fully-opened door locking device 10C engage with each other, and the pawl 30 frictionally engages with the latch 20. Even in this case, the handle 95 is operated, and the open cable 94W is pulled toward the remote control device 91, so that the pawl 30 of the fully-opened door locking device 10C can be moved to its release position by the power of the driving motor 41M. This makes it possible to close the slide door 90 easily.

Now, as shown in FIG. 11, in a case where the release input board 170, the slide rotation board 175, and the releasing lever 165 have abnormally stopped along with the driving motor 41M in a state where the release cable 91W is pulled toward the closing device 10B from the remote control device 91, the ECU detects this abnormal stop from a state where electric current is applied to the driving motor 41M, or the like, and turns on a warning lamp (an example of an abnormality notifying unit) of a driver's seat (not shown). In this state, since the opening lever 60 pushes down the push-down pin 135 of the pawl driving lever 133 and the pawl 30 does not return from its release position, the latch 20 cannot be held in the state of engaging with the striker 40. That is, it is not possible to bring a fully closed state where the slide door 90 is fully closed.

In such a case, a driver has only to switch the slide rotation board 175 to the power shutoff position. That is, a tool (a key, a driver, or the like of a vehicle) is inserted through the operating hole 90R for emergency provided at the rear end wall of the slide door 90, and the cancel operating bar 176 is pushed to the deep side. Then, the slide rotation board 175 is linearly moved along the long hole 177, and the connecting rotation protrusion 175A is pushed out to the outside of the protrusion receiving groove 165R of the releasing lever 165, thereby releasing the connecting between the slide rotation board 175 and the releasing lever 165 (refer to FIG. 12). Thereby, the transmission of power between the connecting rotation protrusion 175A and the releasing lever 165 is shut off, and the releasing lever 165 becomes freely rotatable with respect to the slide rotation board 175. In addition, turn-on of the warning lamp is performed by detecting that the slide rotation board 175 has been operated in a suitable position. When the connecting rotation protrusion 175A is pushed out from the protrusion receiving groove 165R, with the first origin holding spring 98S, the remote control rotating lever 98 is returned to its origin position (position shown in FIG. 16), and thereby, the release cable 91W is pulled toward the remote control device 91. As shown in FIG. 13, the releasing lever 165 individually rotates with respect to the slide rotation board 175, and is returned to its original position. Additionally, when the releasing lever 165 rotates, the protrusion movement regulating portion 165A of the releasing lever 165 faces the connecting rotation protrusion 175A from the rotational shaft 65J, thereby regulating approaching of the connecting rotation protrusion 175A toward the rotational shaft 65J. That is, the slide rotation board 175 is maintained in the power shutoff position.

Thereby, even if the driving motor 41M has abnormally stopped, the pawls 30 of the closed door locking device 10A, the closing device 10B, and the fully-opened door locking device 10C move to positions where they engage the latches 20 from their release positions, and the slide door 90 can be maintained in a closed state.

Figure 14:
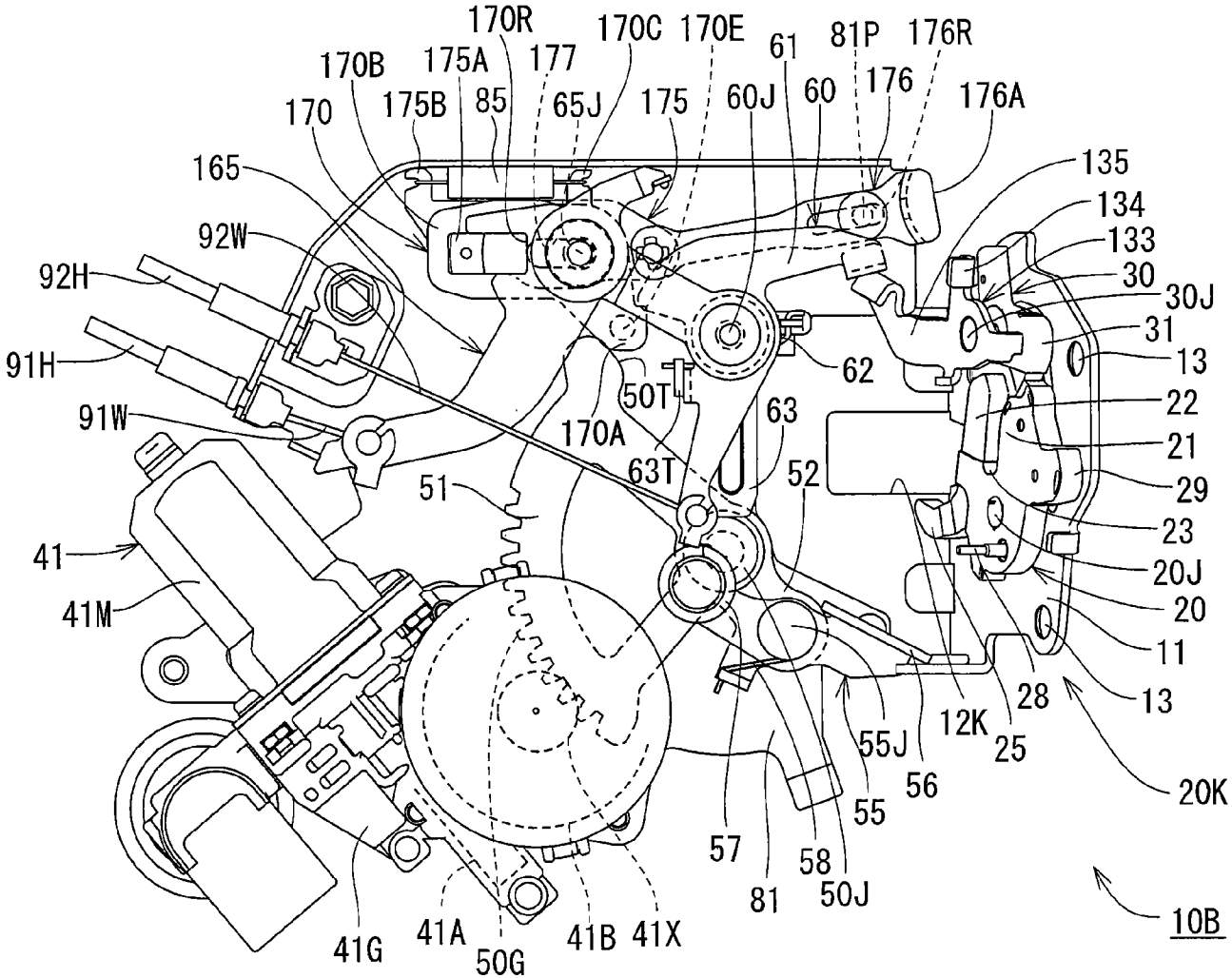
FIG. 14 is a front view of the closing device immediately before the latch driving motor recovers and the slide rotation board returns to a power transmission position.

Moreover, when the driving motor 41M recovers and the active lever 50 rotates in a direction apart from the release input board 170 (contacting boss 170E) in a state where the slide rotation board 175 is in the power shutoff position and only the releasing lever 165 is independently returned to its original position (state of FIG. 13), as shown in the change from FIG. 13 to FIG. 14, the release input board 170 and the slide rotation board 175 return to their original positions by the biasing force of the torsion spring 170S (refer to FIG. 8). When the protrusion engaging hole 170R provided in the release input board 170, and the protrusion receiving groove 165R of the releasing lever 165 overlap each other and coincide with each other, the connecting rotation protrusion 175A of the slide rotation board 175 is again received in the protrusion receiving groove 165R of the releasing lever 165 by the biasing force of the spring 85. That is, the slide rotation board 175 returns automatically to the power transmission position, and the cancel operating bar 176 is pushed back toward the operating hole 90R for emergency of the slide door 90 (refer to FIG. 10).

As described above, according to the closing device 10C of this embodiment, in a case where the driving motor 41M malfunctions in a state where the pawl 30 is in its release position, the slide rotation board 175 is moved from the power transmission position to the power shutoff position by manual operation, and thereby, the transmission of power between the driving motor 41M and the pawl 30 is shut off, so that the pawl 30 can be returned to a latched position by the biasing force of the torsion spring 30S. This makes it possible to lock the door 10 in a fully closed state. Additionally, in a case where the driving motor 41M malfunctions in a state where the pawl 30 is held in its release position, the warning lamp notifies a driver of abnormality. Thus, rapid response can be made. In addition, the abnormality notifying unit may be warning sound or alarm besides the warning lamp.

Additionally, the pressing and operating piece 176A of the cancel operating bar 176 is arranged to face the operating hole 90R for emergency formed in the position (rear end wall of the slide door 90) in the slide door 90 which is sandwiched and hidden between the door and the door frame 99W when being closed, the pressing and operating piece 176A is not easily found out by a person who does not know an operational purpose, and can be prevented from being operated erroneously. In addition, if the operating hole 90R for emergency is normally sealed and the seal is made detachable as required, an erroneous operation can be prevented more reliably.

Additionally, in a case where the driving motor 41M has recovered after the slide rotation board 175 is manually moved to the power shutoff position, the slide rotation board 175 returns automatically to the power transmission position. Thus, the operation of returning the slide rotation board to the power transmission position manually becomes unnecessary.

Since the tip portion of the cancel operating bar 176 is connected with the base end of the slide rotation board 175, as shown in FIGS. 8 to 11, the pressing and operating piece 176A provided at the base end of the cancel operating bar 176 swings up and down with the pin 81P as a fulcrum along with the rotation of the slide rotation board 175. In contrast, in this embodiment, the portion of the cancel operating bar 176 on the side of the pressing and operating piece 176A with respect to the pin 81P is made shorter than the portion of the cancel operating bar on the side of the slide rotation board 175 with respect to the pin 81P (in other words, the long hole 176R which has received the pin 81P is provided nearer the pressing and operating piece 176A than the longitudinal central portion of the cancel operating bar 176, the swing width of the pressing and operating piece 176A accompanying the rotation of the slide rotation board 175 can be made relatively small. Thereby, the clearance for avoiding any interference between the pressing and operating piece 176A and other parts can be suppressed small.

Additionally, according to this embodiment, the driving motor 41M can be used as both a power source for switching from a half-closed state to a fully closed state, and a power source for assisting in handle operation when the slide door 90 is opened, and manufacturing cost and weight can be suppressed.

Second Embodiment

The closing device 10B according to a second embodiment is shown in FIGS. 17 to 23. This second embodiment is different from the above first embodiment in the structure of the first canceling mechanism of the closing device 10B, and the shape of the latch and pawl driving lever provided in the latch and pawl mechanism 20K of the closing device 10B. Since the other configurations are the same as those of the above first embodiment, the same configurations are denoted by the same reference numerals, and the duplicate description thereof will be omitted.

Figure 17:
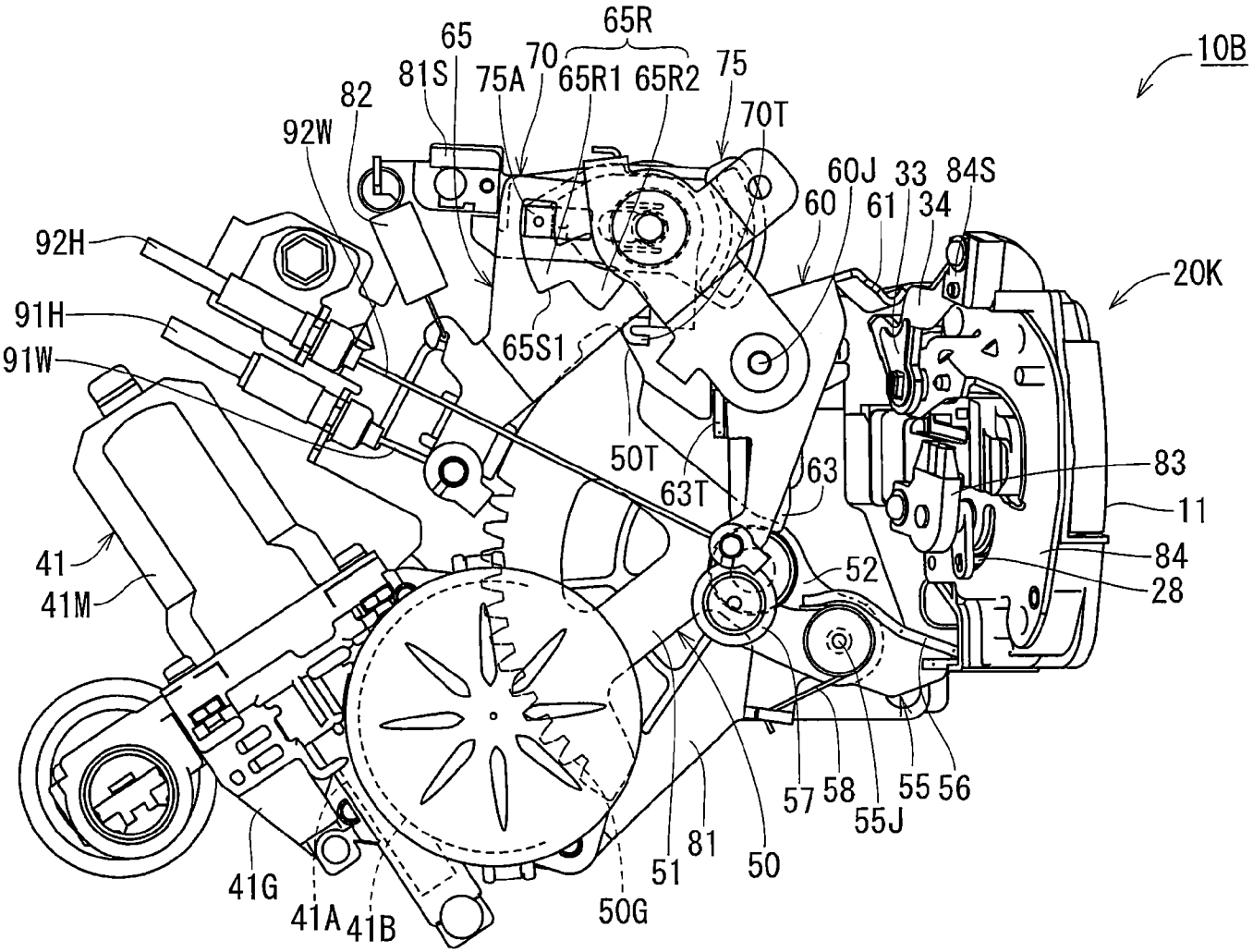
FIG. 17 is a front view of the closing device according to a second embodiment.

The whole closing device 10B of this embodiment is shown in FIG. 17. Reference numeral 84 in this drawing represents a latch pawl cover which covers the latch 20, reference numeral 83 represents a latched position detecting sensor for detecting whether or not the latch 20 is arranged in any position of a half-latched position (refer to FIG. 18), a fully latched position (refer to FIG. 19), and an unlatched position (refer to FIG. 21), and reference numeral 84S represents a stopper provided in the latch pawl cover 84.

Figure 18:
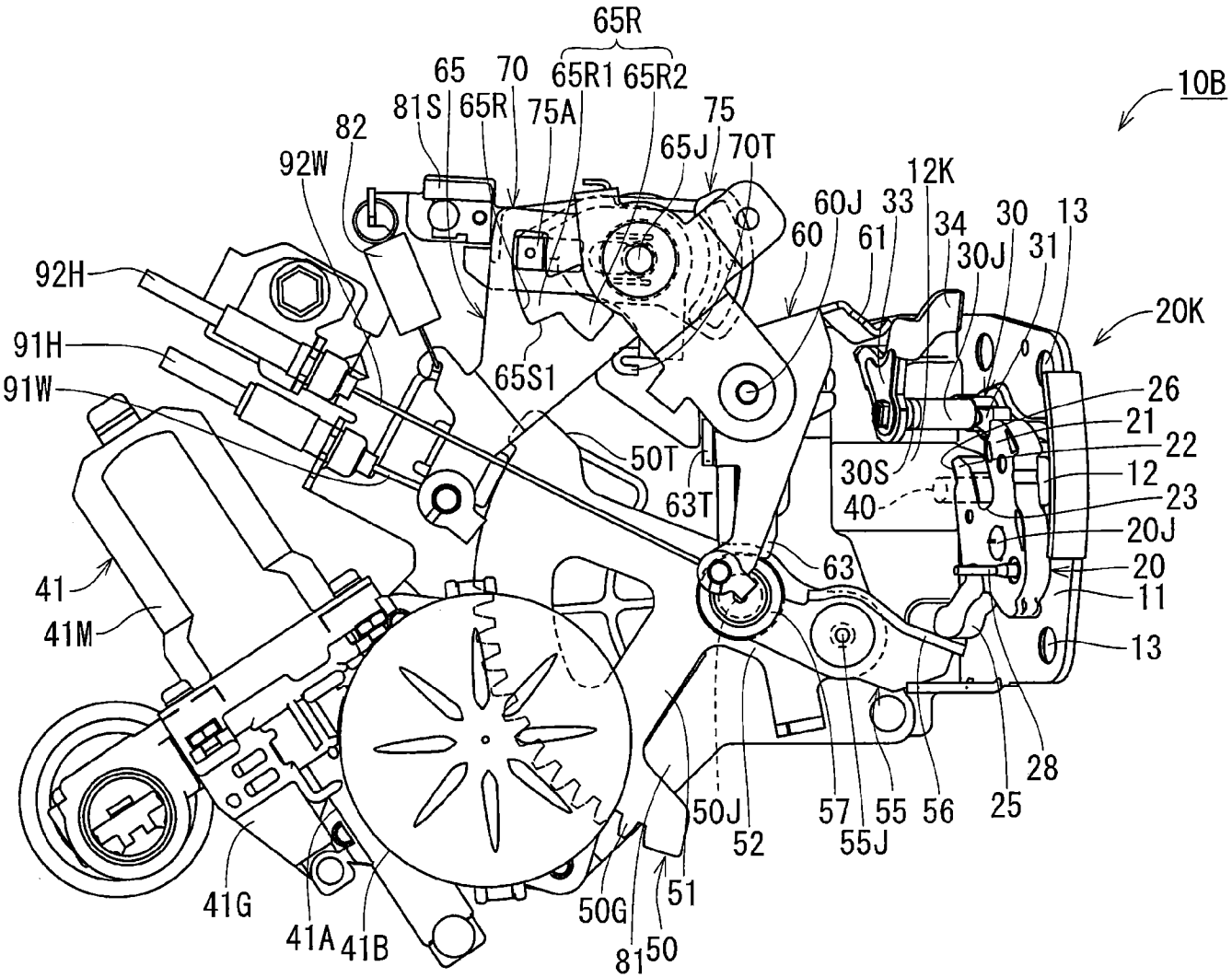
FIG. 18 is a front view of the closing device in a half latch state.
Figure 19:
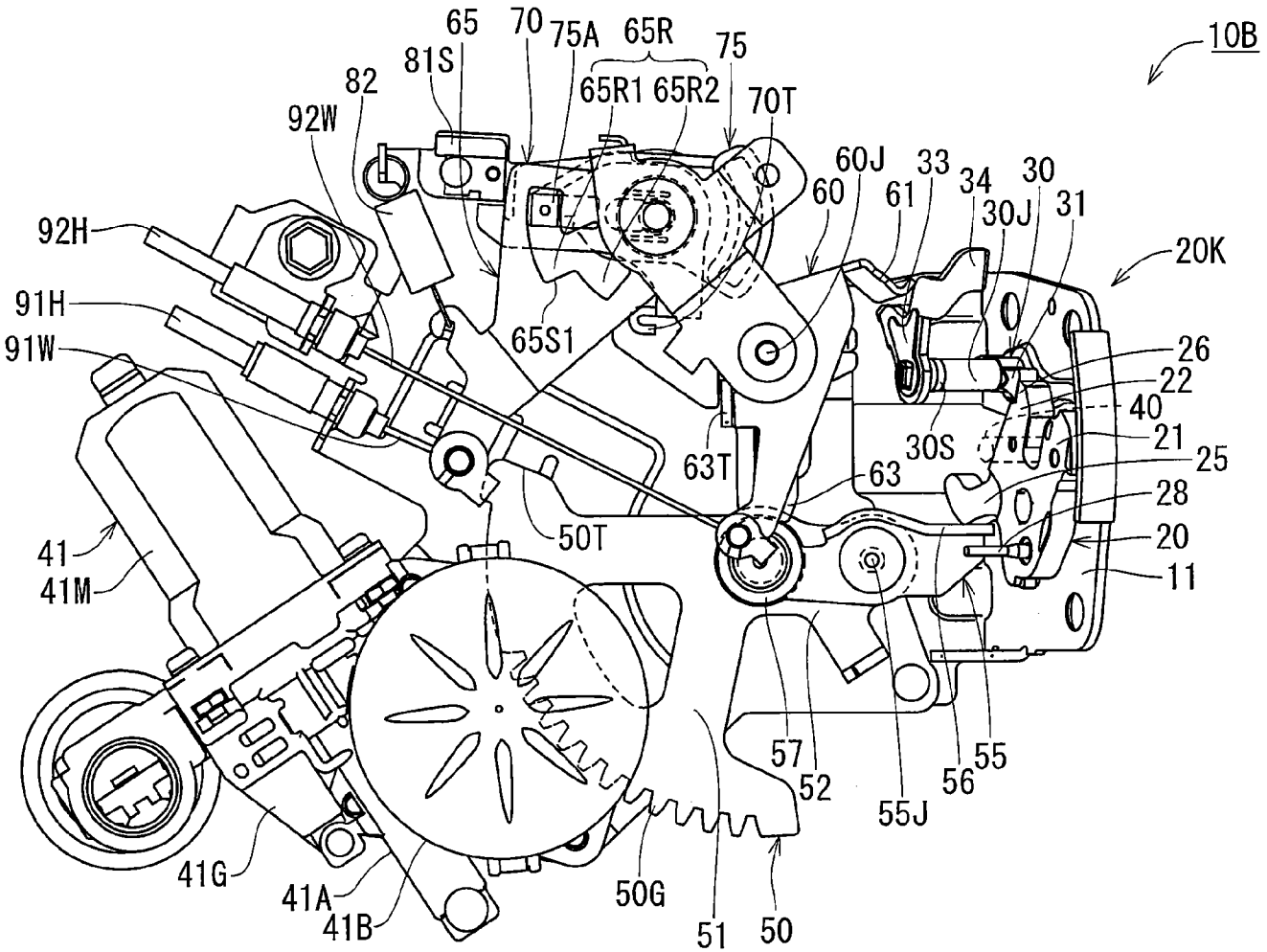
FIG. 19 is a front view of the closing device in a full latch state.

As shown in FIG. 18, the latch 20 did not have the half latch locking protrusion in the above first embodiment, but employs only the latch driving lever 25 and the position detecting pin 28. The tip portion of the position-detecting pin 28 is connected with the latched position detecting sensor 83 through the latch pawl cover 84 (refer to FIG. 17). The latch driving lever 25 is directed obliquely downward in a state where the pawl 30 has contacted the front locking claw 22 of the latch 20 and the latch 20 is brought in the half-latched position (refer to FIG. 18). In this state, when the latch driving lever 25 is pushed up by the seesaw-type rotation board 55, the latch 20 moves to the fully latched position (refer to FIG. 19) A where the pawl 30 has contacted the tip portion of the rear locking claw 22.

The pawl driving lever 33 projects sideways from the tip portion of the rotational shaft 30J of the pawl 30. The tip portion of the pawl driving lever 33 is bifurcated, and a stopper piece 34 is formed so as to protrude from one of the tip portions of the bifurcated pieces. Then, as the stopper piece 34 contacts the stopper 84S provided in the latch pawl cover 84, the pawl 30 is positioned in a position where it can regulate the rotation of the latch 20. Additionally, the other of the tip portions of the bifurcated pieces of the pawl driving lever 33 can be pushed down by the push-down piece 61 of the opening lever 60.

Figure 23A:
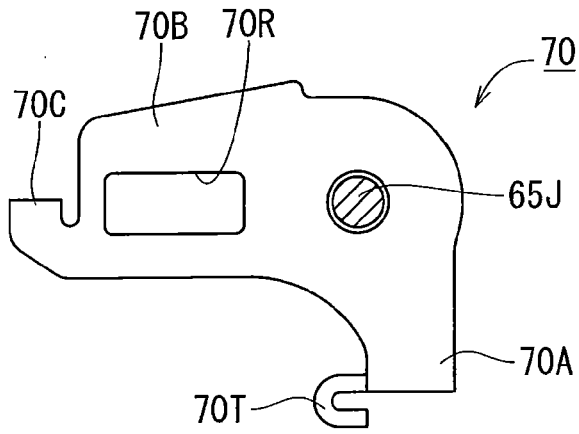
FIGS. 23A to 23C are front views of component parts of the first canceling mechanism.

As shown in FIG. 17, the release input board 70 (an example of a motor-side rotation board), the slide rotation board 75 (an example of a relay rotation board), and the releasing lever 65 (an example of a pawl-side rotation board) are supported above the opening lever 60 so as to be rotatable about the common rotational shaft 65J, and constitutes a "first canceling mechanism" according to the embodiment of the invention. The release input board 70, as shown in FIG. 23A, has a first rotation piece 70A which extends downward from the rotational shaft 65J, and a second rotation piece 70B which extends in a transverse direction. The second rotation piece 70B is formed with a sideways long rectangular protrusion engaging hole 70R. Additionally, the tip of the second rotation piece 70B is formed with a stopper contacting portion 70C which is directed upward. As shown in FIG. 17, the stopper contacting portion 70C contacts the stopper 81S provided in the mechanism plate 81, and the release input board 70 is positioned at the end of a rotatable range.

The first rotation piece 70A is formed with a curved contacting portion 70T by bending and raising a lower piece of the first rotation piece toward the mechanism plate 81 and as shown in FIG. 17, by curving the raised portion in the shape of the letter U while making the raised portion toward the side opposite the latch and pawl mechanism 20K. When the active lever 50 is rotated in a clockwise direction by the driving motor 41M, the pressing portion 50T provided in the active lever 50 contacts the curved contacting portion 70T, and the release input board 70 rotates in a counterclockwise direction in this drawing.

Figure 23B:
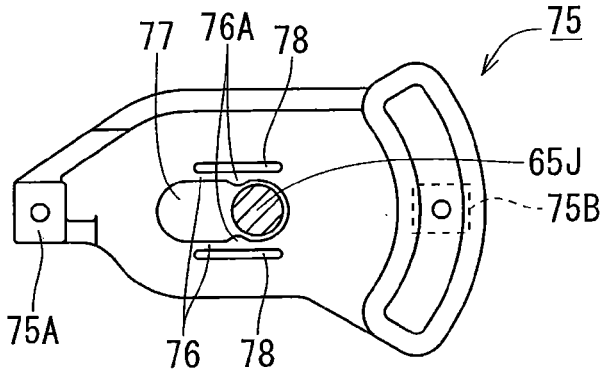

The slide rotation board 75, as shown in FIG. 17, is arranged between the release input board 70 and the mechanism plate 81. Additionally, the slide rotation board 75 extends in a longitudinal direction of the second rotation piece 70B in the release input board 70. The portion of the slide rotation board on the tip side is formed in a tapered shape, and the portion of the slide rotation board on the proximal side is formed in a fan shape. As shown in FIG. 23B, the slide rotation board 75 is formed with a long hole 77 (an example of a pivot penetration long hole) which extends in the longitudinal direction, and a pair of slits 78 and 78 are formed parallel to the long hole 77 on both sides of the long hole 77. Additionally, a pair of projections 76A and 76A are formed so as to protrude from positions (positions near the right end of FIG. 23B) near the base end of the long hole 77 on both inner surfaces of the long hole 77. The locking between the rotational shaft 65J, which has passed through the base end of the long hole 77, and the projections 76A and 76A regulates movement of the slide rotation board 75 in a direction orthogonal to the axial direction of the rotational shaft 65J. Additionally, when an external force is applied in the longitudinal direction of the slide rotation board 75, a double-supported beam portion 76 between the long hole 77 and each slit 78 are deflected, so that the projections 76A and 76A can ride over the rotational shaft 65J, and the slide rotation board 75 can be slid. Here, the position of the slide rotation board 76 when the rotational shaft 65J has been arranged at the base end (right end of FIG. 23B) of the long hole 77 corresponds to an example of a power transmission position relating to a relay rotation board according to the embodiment of the invention, and the position of the slide rotation board 75 when the rotational shaft 65J has been arranged at the tip portion (left end of FIG. 23B) of the long hole 77 corresponds to an example of a power shutoff position relating to the relay rotation board.

A cancel operating protrusion 75B (an example of a cancel operating portion) for slidingly operating the slide rotation board 75 between the power transmission position and the power shutoff position is provided at the base end of the slide rotation board 75. The base end of the slide rotation board 75 is exposed to the side from an outer edge of the mechanism plate 81, and the cancel operating protrusion 75B (as shown in FIG. 23B) protrudes from the exposed portion. Additionally, from the tip portion of the release input board 70, a connecting rotation protrusion 75A protrudes toward the side away from the mechanism plate 81. The connecting rotation protrusion 75A is formed in a prismatic shape of a width approximately equal to the width of the protrusion engaging hole 70R of the release input board 70, and is also received within a crank groove 65R of the releasing lever 65, which will be described later, through its protrusion engaging hole 70R.

Figure 22:
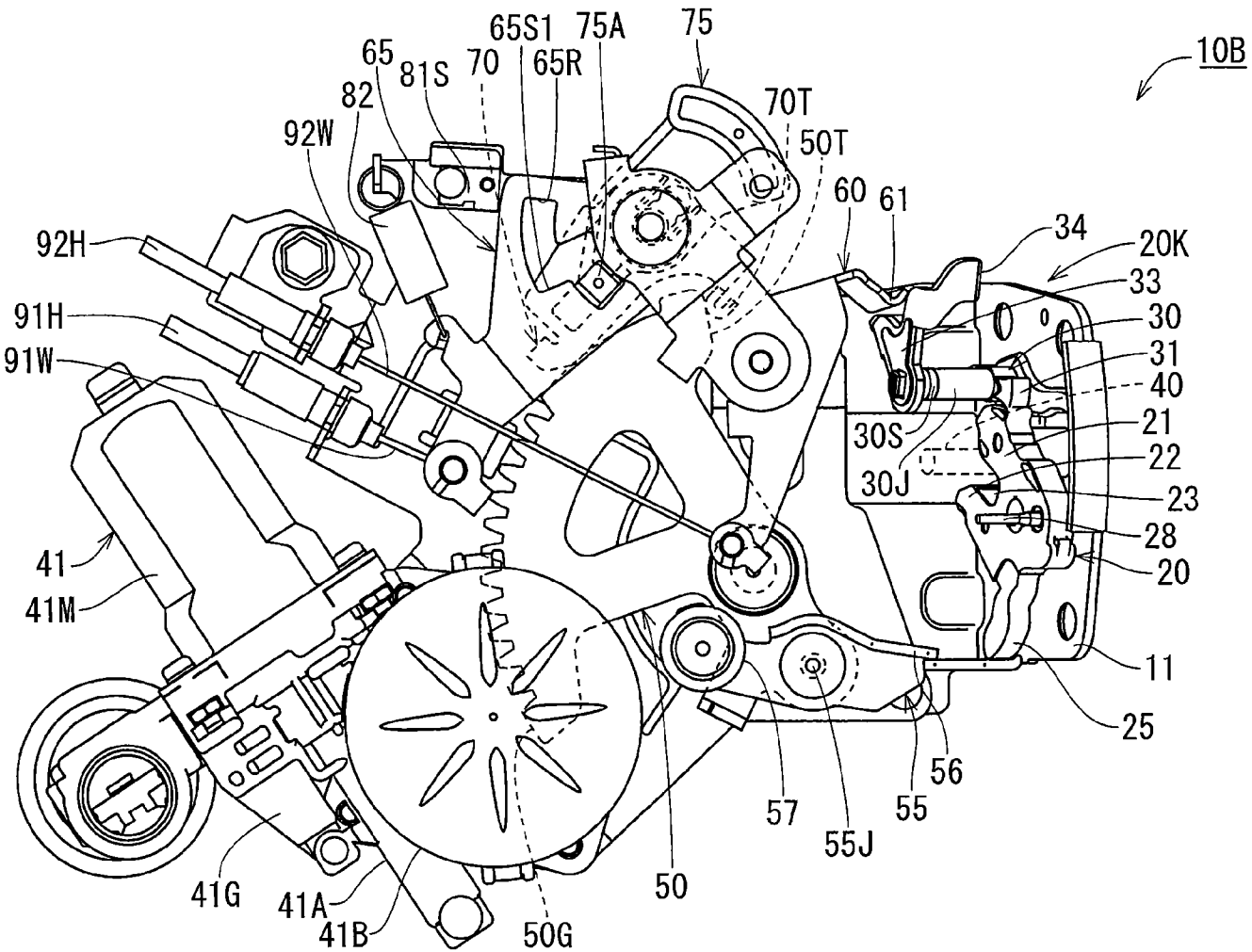
FIG. 22 is a front view of the closing device in a state where the transmission of power between the latch driving motor and the pawl has been shut off at the time of an abnormal stop of the latch driving motor.
Figure 23C:
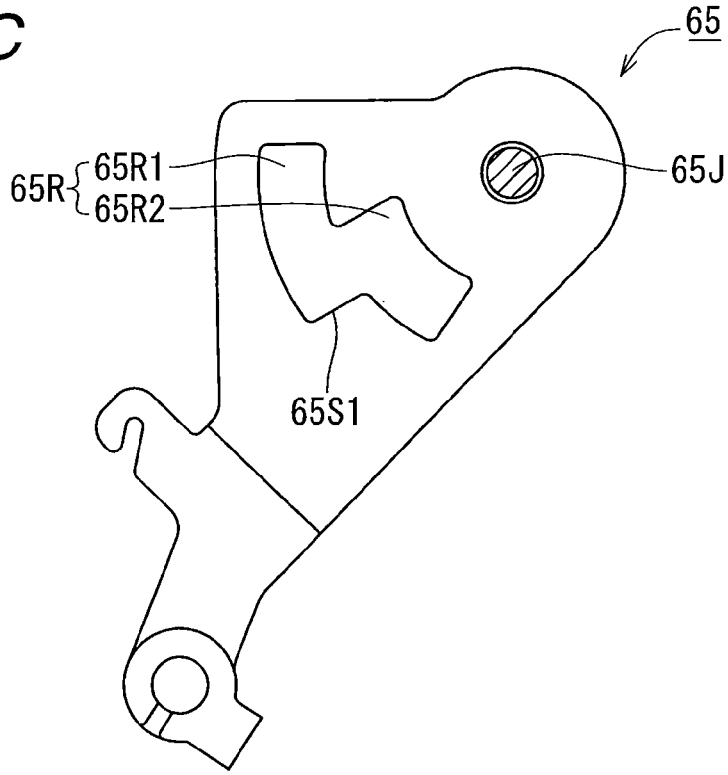

The releasing lever 65, as shown in FIG. 23C, extends obliquely downward from the rotational shaft 65J, and one end of the release cable 91W, as shown in FIG. 17, is connected with a lower end of the releasing lever. The other end of the release cable 91W is connected with the remote control device 91, and an intermediate portion of the release cable 91W is covered with a cladding tube 91H. Additionally, the releasing lever 65 is biased in the clockwise direction in FIG. 17 by a spring 82. Moreover, the portion of the releasing lever 65 from a base end in the vicinity of the rotational shaft 65J to an intermediate portion has a width which is increased in the shape of a fan, and the crank groove 65R is formed there. As shown in FIG. 23C, the crank groove 65R connects an outside circular-arc groove 65R1 in the shape of a circular arc having the rotational shaft 66J as its center, and an inside circular-arc groove 65R2 whose radius of curvature is smaller than that of the outside circular-arc groove 65R1, and the whole crank groove is formed substantially in the shape of a crank. When the slide rotation board 75 is arranged in the power transmission position as shown in FIGS. 17 to 21, the connecting rotation protrusion 75A is received in the outside circular-arc groove 65R1, and when the slide rotation board 75 is arranged in the power shutoff position as shown in FIG. 22, the connecting rotation protrusion 75A is received in the inside circular-arc groove 65R2.

Here, when the release input board 70 rotates under the power from the active lever 50 in a state where the connecting rotation protrusion 75A has been received in the outside circular-arc groove 65R1, the slide rotation board 75 rotates integrally therewith. Then, as shown in the change FIG. 19 to FIG. 20, the connecting rotation protrusion 75A moves the outside circular-arc groove 65R1 from one end to the other end, and contacts the protrusion contacting portion 65S1 of the end of the outside circular-arc groove 65R1. Then, when the release input board 70 and the slide rotation board 75 further rotates, as shown in the change from FIG. 20 to FIG. 21, the connecting rotation protrusion 75A pushes the protrusion contacting portion 65S1, and thereby, the releasing lever 65 rotate under the power from the slide rotation board 75, so that the release cable 91W can be pulled toward the closing device 10B from the remote control device 91.

Figure 21:
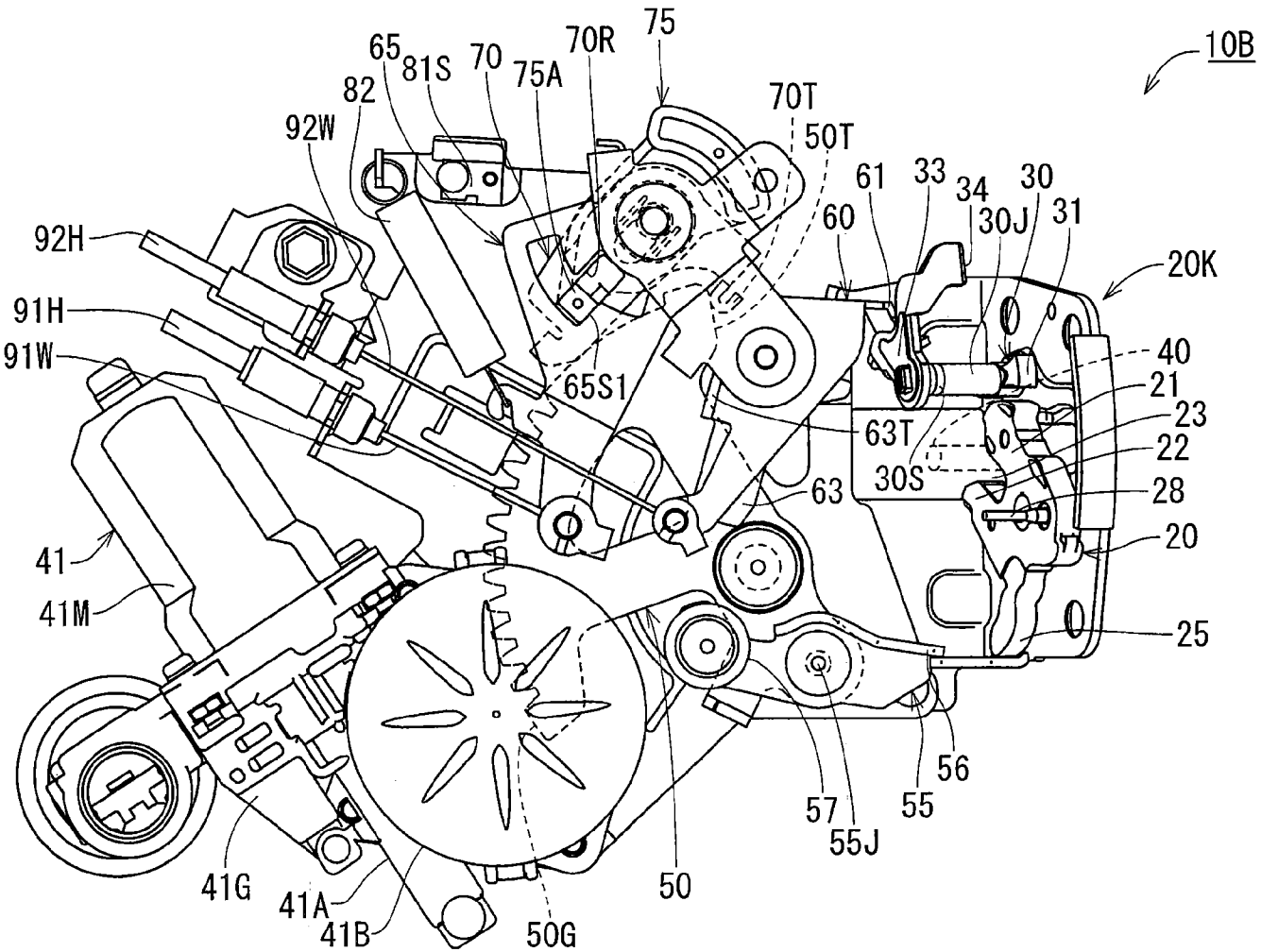
FIG. 21 is a front view of the closing device in a state where the pawl has been moved to a release position by the power of the latch driving motor.

Additionally, as shown in FIG. 21, when the connecting rotation protrusion 75A has contacted the protrusion contacting portion 65S1, the slide rotation board 75 is moved to the power shutoff position, so that the connecting rotation protrusion 75A can be moved to the inside circular-arc groove 65R2. Then, the transmission of power from the connecting rotation protrusion 75A to the releasing lever 65 is shut off, so that the connecting rotation protrusion 75A can be relatively freely turned inside the circular-arc groove 65R2. As a result, the transmission of power and reaction force from the slide rotation board 75 to the releasing lever 65 is shut off.

The description about the configuration of this embodiment has been given above. Next, the operational effects of this embodiment by the above configuration will be described. In addition, since the closed door locking device 10A and the fully-opened door locking device 10C, and operations other than the first canceling mechanism of the closing device 10B are almost the same as those of the first embodiment, the description thereof will be omitted.

When the slide door 90 is operated in a state where the handle 95 is in a fully closed state, the ECU make the motor output shaft of the driving motor 41M rotate before the frictional resistance between the pawl 39 and the latch 20 is applied to the handle 95.

Figure 20:
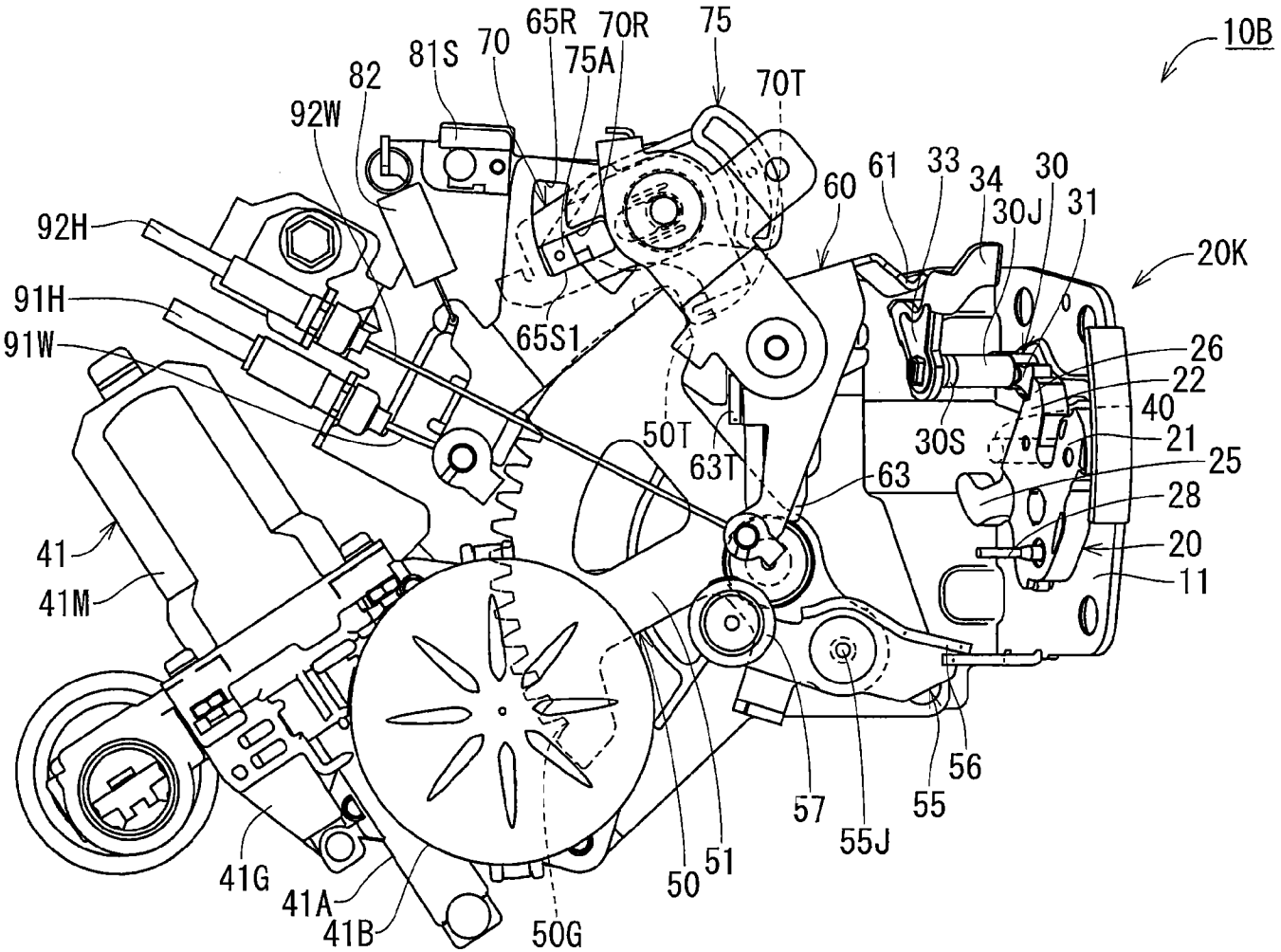
FIG. 20 is a front view of the closing device in a state where power has been transmitted to the releasing lever.

Then, the active lever 50 is rotationally driven in the clockwise direction in FIG. 20, and the release input board 70 and the slide rotation board 75 receive the power from the active lever 50, and rotates in the counterclockwise direction in this drawing. Then, when the connecting rotation protrusion 75A of the slide rotation board 75 contacts the protrusion contacting portion 65S1 on the side of one end in the outside circular-arc groove 65R1 of the releasing lever 65, as shown in the change from FIG. 20 to FIG. 21, the releasing lever 65 rotate along with the release input board 70 and the slide rotation board 75, and the release cable 91W is pulled toward the closing device 10B. Thereby, the remote control rotating lever 98 of the remote control device 91 rotates, and the open cables 92W and 93W are pulled toward the remote control device 91, so that the pawls 30 of the closed door locking device 10A and the closing device 10B can be moved to their release positions by the power of the driving motor 41M, and the slide door 90 can be opened easily.

As shown in FIG. 21, in a case where the release input board 70 and the slide rotation board 75 have abnormally stopped along with the driving motor 41M in a state where the release cable 91W is pulled toward the closing device 10B from the remote control device 91, the ECU detects this abnormal stop from a state where electric current is applied to the driving motor 41M, or the like, and turns on a warning lamp (an example of an abnormality notifying unit) of a driver's seat (not shown). In this case, a driver has only to grip the cancel operating protrusion 75B and make the slide rotation board 75 slide obliquely upward and move to the power shutoff position. Then, the contact between the connecting rotation protrusion 75A and protrusion contacting portion 65S1 is released, and the connecting rotation protrusion 75A is received in the inside circular-arc groove 65R2. Thereby, the transmission of power from the connecting rotation protrusion 75A to the releasing lever 65 is shut off. In addition, turn-on of the warning lamp is performed by detecting that the slide rotation board 75 has been operated in a suitable position. Then, as the connecting rotation protrusion 75A relatively turns inside the circular-arc groove 65R2, the releasing lever 65 is pulled by the spring 82 and returns to its original position. Thereby, even if the remote control rotating lever 98 also returns to its origin position and the driving motor 41M has abnormally stopped, the pawls 30 of the closed door locking device 10A, the closing device 10B, and the fully-opened door locking device 10C move to positions where they engage the latches 20 from their release positions, and the slide door 90 can be maintained in a closed state. As described above, even in this embodiment, the same effects as those of the above first embodiment are exhibited.

Other Embodiments

The invention is not limited to the above embodiments. For example, embodiments as will be described below are also included in the technical range of the invention, and besides the following embodiments, various changes can be made without departing from the spirit or scope of the invention.

Figure 24:
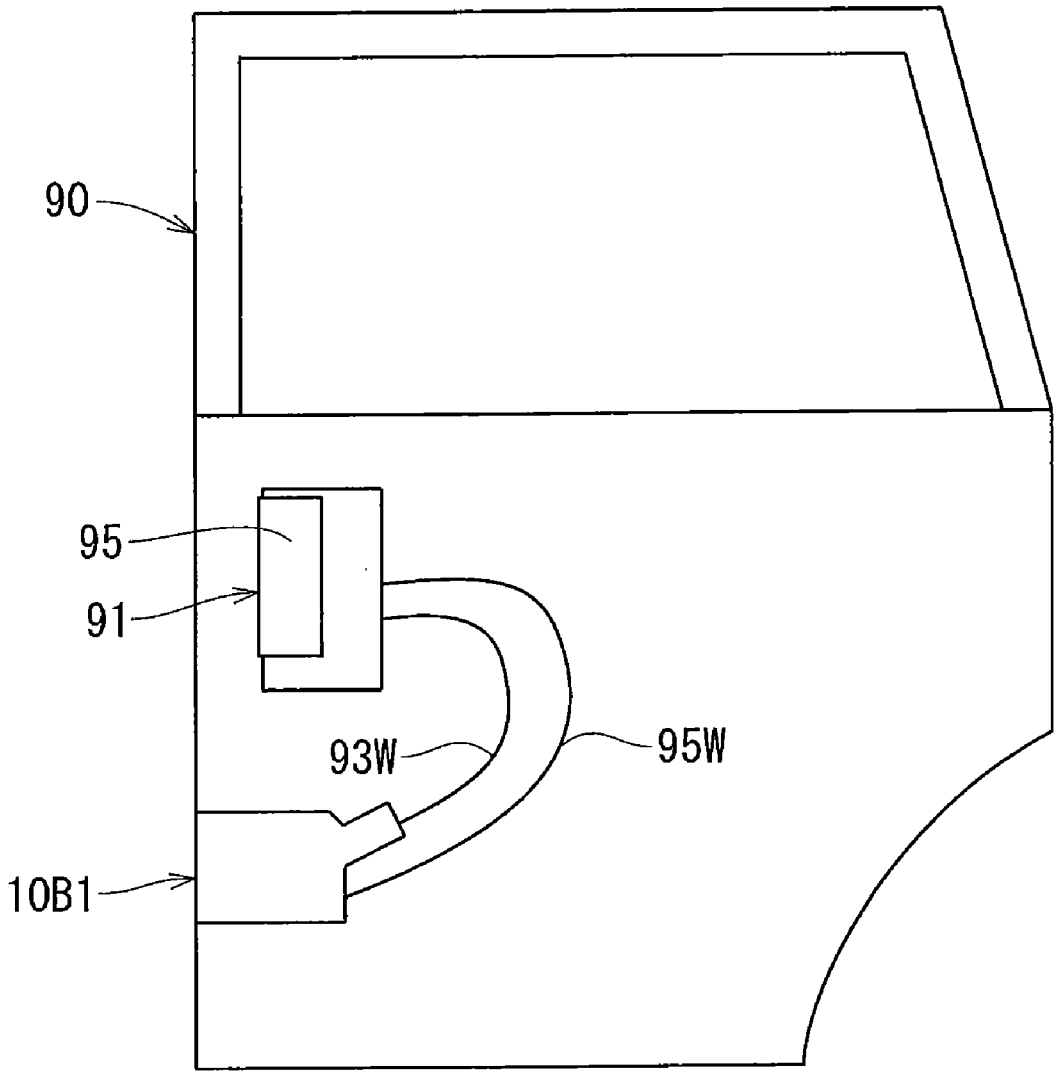
FIG. 24 is a schematic diagram of a slide door including a vehicle door latch device of Modification 1.

(1) The vehicle door locking system 10 of the above embodiments is provided with the closed door locking device 10A and the fully-opened door locking device 10C other than the closing device 10B to which the invention is applied. However, as shown in FIG. 24, a configuration may be adopted in which a closing device 10B1 (including the same actuator 41, release power transmitting unit, and closing power transmitting unit as the closing device 10B of the above embodiments) to which the invention is applied is provided at a front end of the slide door 90, and the closing device 10B and the fully-opened door locking device 10C are not provided. Additionally, a configuration may be adopted in which the closed door locking device 10B1 to which the invention is applied, and the fully-opened door locking device 10C described in the above embodiments are included, and the closing device 10B is not provided. Moreover, a configuration may be adopted in which the closed door locking device 10A and the closing device 10B described in the above embodiments are included, and the fully-opened door locking device 10C is not provided.

Figure 25:
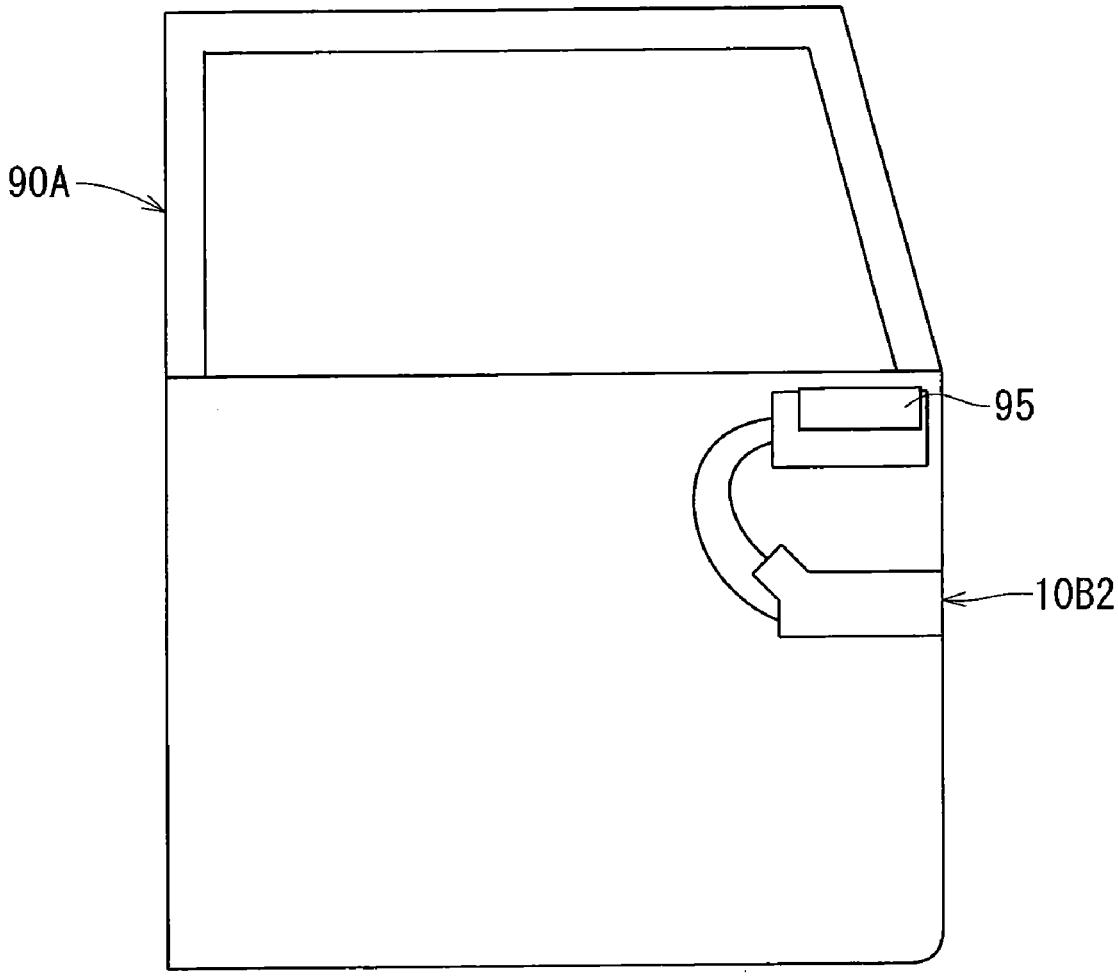
FIG. 25 is a schematic diagram of a rotary door including a vehicle door latch device of Modification 2.

(2) In the above embodiments, the invention has been applied to the closing device 10C attached to the slide door 90. However, as shown in FIG. 25, the invention can be applied to a rotary door locking device 10B2 attached to a rotary door 90A which is rotatably provided in a vehicle body. In this case, the rotary door locking device 10B2 may be configured such that a latch and pawl mechanism, the actuator 41, a release power transmitting unit, and a closing power transmitting unit are provided.

(3) In the above second embodiment, in a case where the driving motor 41M of the closing device 10B has abnormally stopped, the cancel operating protrusion 75B is operated to shut off a transmission system of power between the driving motor 41M and the pawl 30. However, for example, configurations as follows may be adopted as other configurations. That is, a configuration may be adopted in which the driving motor 41M and the pawl 30 are held in a state where power can be transmitted therebetween while the handle 95 of the remote control device 91 is operated and the handle moves from a starting end of a movable range to a point before a terminal end thereof, the driving motor and the pawl are switched to a state where power has been shut off therebetween when the handle 95 reaches the terminal end of the movable range, and the driving motor and the pawl return to a state where transmission of power can be made therebetween when the handle 95 returns to the starting end of the movable range.

(4) Additionally, the cancel operating protrusion 75B operated in a case where the driving motor 41M has abnormally stopped may be arranged on the surface of the slide door 90 which faces the inside of a vehicle. For example, the cancel operating protrusion 75B may be arranged on the surface of a door which faces the inner surface of a door frame, and may be sandwiched and hidden between the door and a vehicle body when the door is closed. If such a configuration may be adopted, the cancel operating protrusion 75B is not easily found out by a person who does not know an operational purpose, and can be prevented from being operated erroneously.

(5) In the above embodiments, the configuration in which both the release power transmitting unit and the closing power transmitting unit are included has been described. However, a configuration may be adopted in which only the release power transmitting unit is included. Specifically, a configuration may be adopted in which the seesaw-type rotation board 55 and the positioning lever 63 are not provided.

As discussed above, the present invention can provide at least the following illustrative, non-limiting embodiments.

[1] A vehicle door latch device comprises: a latch which is attached to the door of a vehicle and rotates while engaging with a striker provided in a vehicle body; a pawl which is rotatable between a latched position where a rotation of the latch is restricted and a unlatched position where the rotation of the latch is permitted; a pawl biasing member which biases the pawl to the latched position; a motor which starts rotating in response to an operation to a door opening operating portion provided in the door; a release power transmitting unit which transmits a rotational power in one direction of the motor to the pawl and rotates the pawl from the latched position to the unlatched position, wherein the pawl is disposed in the latched position to hold the door in a closed position, and the pawl is rotationally driven from the latched position to the unlatched position by the rotational power of the motor in response to the operation to the door opening operating portion, thereby allowing the door to be opened, a motor-side rotation board, a relay rotation board, and a pawl-side rotation board which are provided in the release power transmitting unit, and which are rotatably supported about a common rotation board rotating pivot; a pivot penetration long hole which is formed only in the relay rotation board among the three rotation boards, which allows the rotation board rotating pivot to pass therethrough, and which allows the relay rotation board to be linearly moved in a direction orthogonal to the rotation board rotating pivot; a first canceling mechanism which in a state where the relay rotation board is arranged in a power transmission position at one end of a linear movable range thereof, connects the motor-side rotation board, the relay rotation board, and the pawl-side rotation board together to be rotatable integrally to one another, thereby allowing the rotational power in one direction of the motor to be transmitted in an order of the motor-side rotation board, the relay rotation board, the pawl-side rotation board and the pawl, and in a state where the relay rotation board is arranged in a power shutoff position at another end of the linear movable range, cancels the connecting, thereby allowing the motor-side rotation board and the pawl-side rotation board to be individually rotatable, and divides the transmission of power from the motor to the pawl, between the motor-side rotation board and the relay rotation board or between the relay rotation board and the pawl-side rotation board; and a cancel operating portion is arranged at a position which faces an operating hole for emergency formed in the door, and which causes the relay rotation board to move to the power shutoff position from the power transmission position by a manual operation to the cancel operating portion when the motor is stopped in a state where the pawl is disposed in the unlatched position.

[2] In the vehicle door latch device in [1], the cancel operating portion may be arranged at a position which faces the operating hole for emergency formed at a position of the door sandwiched and hidden between the door and the vehicle body, and the relay rotation board may move to the power shutoff position from the power transmission position by the cancel operating portion being pressed.

[3] The vehicle door latch device in [2] may further comprise an operating force transmitting member which extends substantially in a horizontal direction, and which includes one end facing an outside of the door via the operating hole for emergency and another end rotatably connected with the relay rotation board, wherein the one end of the operating force transmitting member may serves as the cancel operating portion, and wherein an intermediate portion of the operating force transmitting member may be supported by an operating portion rotating pivot to be rotatable and linearly movable, the operating portion rotating pivot extending in parallel with the rotation board rotating pivot.

[4] In the vehicle door latch device in [3], a portion of the operating force transmitting member on a side of the cancel operating portion from the operating portion rotating pivot may be shorter than a portion of the operating force transmitting member on a side of the relay rotation board from the operating portion rotating pivot.

[5] In the vehicle door latch device in [3] or [4], the first canceling mechanism may include: a connecting rotation protrusion which is provided at a portion of the relay rotation board opposite to the operating force transmitting member with the rotation board rotating pivot therebetween, which protrudes in a direction parallel to the rotation board rotating pivot, which approaches the rotation board rotating pivot when the relay rotation board moves to the power transmission position, and which separates from the rotation board rotating pivot when the relay rotation board moves to the power shutoff position; a protrusion engaging groove which is formed in the motor-side rotation board to receive the connecting rotation protrusion so as to be linearly movable in a direction in which the protrusion approaches and separates from the rotation board rotating pivot, which engages with a side surface of the connecting rotation protrusion in the whole linear movable range to connect the relay rotation board and the motor-side rotation board to be integrally rotatable; a protrusion receiving recess which is formed in the pawl-side rotation board, which receives the connecting rotation protrusion to connect the relay rotation board and the pawl-side rotation board to be integrally rotatable when the connecting rotation protrusion is disposed at one end of the linear movable range on a side of the rotation board rotating pivot, and which allows the connecting rotation protrusion to separate from the protrusion receiving recess, so that the relay rotation board and the pawl-side rotation board becomes individually rotatable when the connecting rotation protrusion is disposed at another end of the linearly movable range apart from the rotation board rotating pivot; and a protrusion movement regulating portion which is formed in the pawl-side rotation board at a side of the protrusion receiving recess, which faces the connecting rotation protrusion separated from the protrusion receiving recess, from a side of the rotation board rotating pivot, and which regulates the connecting rotation protrusion approaching the rotation board rotating pivot.

[6] The vehicle door latch device in [5] may further comprise: a relay rotation board biasing member which biases the relay rotation board toward the power transmission position, and a motor-side rotation board biasing member which biases the motor-side rotation board in a direction opposite to a rotational direction by the rotational power in the one direction of the motor, wherein, when the motor stops in the unlatched position, and the relay rotation board is moved to the power shutoff position by the operation to the cancel operating portion, the pawl rotates to the latched position by the pawl biasing member, and in conjunction with the pawl, the pawl-side rotation board rotates and the connecting rotation protrusion is locked to the protrusion movement regulating portion, and wherein, when the motor recovers and rotates in a direction opposite to the one direction, the motor-side rotation board is rotationally driven by the motor-side rotation board biasing member, the connecting rotation protrusion is received in the protrusion receiving recess, and the relay rotation board returns to the power transmission position.

[7] The vehicle door latch device in any one of [3] to [6], wherein the cancel operating portion is arranged at a position which is capable of being pressed by a tool inserted through the operating hole for emergency. The tool may be a key of a vehicle, or may be a shaft-shaped or rod-shaped tool (specifically, a driver or the like) which is usually mounted on a vehicle like a vehicle-mounted tool. Additionally, the tool may be a pen, not limited to a tool. Moreover, the tool may be an exclusive tool for pressing and operating the cancel operating portion.

[8] The vehicle door latch device in any one of [1] to [7] may further comprise an abnormality notifying unit which notifies abnormality in a case where the motor malfunctions in a state where the pawl is held in the unlatched position.

[9] In the vehicle door latch device in any one of [1] to [8], the release power transmitting unit may include an active rotation board which is gear-connected with a rotation output shaft of the motor, and when being rotatably driven by the rotational power in the one direction of the motor, presses an end of the motor-side rotation board apart from a rotation center of the motor-side rotation board, thereby transmitting power to the motor-side rotation board, and when the active rotation board is rotationally driven toward a side away from the motor-side rotation board by the rotational power in a direction opposite to the one direction of the motor, the active rotation board is adapted to transmit the rotational power to the latch, thereby rotationally driving the latch in a locking direction in which the engagement with the striker is deepened, thereby causing the door to a fully-closed state.

[10] The vehicle door latch device in [9] may further comprise a second canceling mechanism in a closing power transmitting unit which transmits power between the motor and the latch. The second canceling mechanism may include: a seesaw-type rotary part which is rotatably supported by the active rotation board at a position offset from a rotational shaft of the active rotation board; and a positioning movable member which is normally arranged in a seesaw contact position where one end of the seesaw-type rotary part is positioned, and moves to a seesaw release position where the positioning is released in conjunction with the operation to the door opening operating portion, wherein, when the positioning movable member is disposed in the seesaw contact position, a rotational shaft of the seesaw-type rotary part moves along with the rotation of the active rotation board where the one end of the seesaw-type rotary part is positioned, thereby providing power to the latch from another end of the seesaw-type rotary part, and wherein when the positioning movable member is disposed in the seesaw release position, the seesaw-type rotary part freely rotates with respect to the active rotation board, and shuts off the power to the latch.

According to the configuration of [1] and [8], in a case where the motor which is driven in response to the operation to the door opening operating portion has abnormally stopped in a state where the pawl is held in the unlatched position, the first canceling mechanism may be brought into a power shutoff state manually. Then, since the transmission of power between the motor and the pawl is shut off, the pawl can be moved to the latched position from the unlatched position, and the door can be locked in a fully-closed state.

In detail, the release power transmitting unit is provided with the motor-side rotation board, the relay rotation board, and the pawl-side rotation board which are rotatably supported about the common rotation board rotating pivot. Normally, the relay rotation board is arranged in the power transmission position on the side of one end of the linear movable range, and the motor-side rotation board, the relay rotation board, and the pawl-side rotation board are integrally and rotatably connected. In this state, when the motor rotates in one direction, the rotational power thereof is transmitted in order of the motor-side rotation board, the relay rotation board, the pawl-side rotation board, and the pawl, and the pawl is rotationally driven from the latched position to the unlatched position.

Here, in a case where the motor has abnormally stopped while the motor has rotated in one direction, the pawl is held in the unlatched position. Thus, it becomes impossible to restrict the rotation of latch. That is, it becomes impossible to bring the door into a fully-closed state. In such a case, the cancel operating portion is operated through the operating hole for emergency formed in the door, and the relay rotation board is moved to the power shutoff position from the power transmission position. Then, since the connecting among the above motor-side rotation board, the relay rotation board, and the pawl-side rotation board is released, and the motor-side rotation board and the pawl-side rotation board become individually rotatable, the pawl returns to the latched position by the biasing force of the pawl biasing member. This makes it possible to lock the latch and the pawl to each other, and lock the door in a fully closed state. Additionally, since the motor-side rotation board, the relay rotation board, and the pawl-side rotation board are supported about the common rotation board rotating pivot, enlargement caused by providing the three rotation boards can be suppressed as much as possible.

Additionally, according to the configuration of [8], in a case where the motor malfunctions in a state where the pawl is held in its unlatched position, the abnormality notifying unit notifies a driver of abnormality. Thus, rapid response can be made. In addition, as the door opening operating portion relating to an embodiment of the invention, a handle, a wireless remote control device, a driver's seat switch, and the like are utilized.

According to the configuration of [2], the relay rotation board can be switched to the power transmission position and the power shutoff position by the pressing operation of the cancel operating portion via the operating hole for emergency. Additionally, the cancel operating portion is arranged to face the operating hole for emergency formed in the position of the door which is sandwiched and hidden between the door and a vehicle door, whereby the cancel operating portion is not easily found out by a person who does not know an operational purpose, and can be prevented from being operated erroneously.

According to the configuration of [3], in a case where the relay rotation board is arranged in a deep position of the operating hole for emergency, the cancel operating portion can be provided in a position in the vicinity of the operating hole for emergency by the operating force transmitting member.

According to the configuration of [4], the operating force transmitting member has the other end opposite to the relay rotation board rotatably connected with the cancel operating portion, and has an intermediate portion rotatably and linearly movably supported by the operating portion rotating pivot. Accordingly, with the rotation of the relay rotation board, the operating force transmitting member swings with the operating portion rotating pivot as a fulcrum. Here, the portion of the operating force transmitting member on the side of the cancel operating portion with respect to the operating portion rotating pivot is shorter than the portion thereof on the side of the relay rotation board with respect to the operating portion rotating pivot. Thereby, the swing width of the cancel operating portion accompanying the rotation of the relay rotation board can be made relatively small.

According to the configuration of [5], the portion of the relay rotation board opposite the operating force transmitting member with the rotation board rotating pivot therebetween is provided with a connecting rotation protrusion which approaches the rotation board rotating pivot in the power transmission position, and separates from the rotation board rotating pivot in the power shutoff position of the relay rotation board, the motor-side rotation board is formed with a protrusion engaging groove which permits the connecting rotation protrusion to be linearly movable in a direction in which the protrusion approaches or separates from the rotation board rotating pivot, and integrally and rotatably connects the relay rotation board and the motor-side rotation board in the whole linear movable range, and the pawl-side rotation board is formed with a protrusion receiving recess which receives the connecting rotation protrusion and integrally and rotatably connects the relay rotation board and the pawl-side rotation board when the connecting rotation protrusion is located in the power transmission position.

Also, in a case where the relay rotation board has been moved to the power shutoff position, when the connecting rotation protrusion moves inside the protrusion engaging groove in a direction apart from the rotation board rotating pivot, and is located at the other end apart from the rotation board rotating pivot, the connecting rotation protrusion separates from the protrusion receiving recess of the pawl-side rotation board. Thereby, the relay rotation board and the pawl-side rotation board become individually rotatable, and the pawl rotates to the latched position by the biasing force of the pawl biasing member. Additionally, the pawl-side rotation board rotates in conjunction with the pawl, and the connecting rotation protrusion and the protrusion movement regulating portion are arranged to face each other. This protrusion movement regulating portion regulates that the connecting rotation protrusion approaches the rotation board rotating pivot inside the protrusion engaging groove, and holds the connecting rotation protrusion in the power shutoff position.

According to the configuration of [6], the relay rotation board can be returned to the power transmission position if the motor recovers and the motor rotates in the other direction after the relay rotation board is located in the power shutoff position manually. Thus, it becomes possible to save the time and effort required from manually returning the relay rotation board to the power transmission position.

According to the configuration of [7], it becomes difficult that the cancel operating portion is immoderately pressed and operated. Here, if a key of a vehicle is used as the tool, an exclusive tool for operating the cancel operating portion becomes unnecessary.

According to the configuration of [9], the motor can be used as both a power source for rotationally driving the pawl from the latched position to the unlatched position when the door is opened, and a power source for rotationally driving the latch in a locking direction in which the engagement with the striker is deepened, thereby brining the door into a fully closed state, and manufacturing cost and weight can be suppressed.

According to the configuration of [10], unless the handle is operated, a positioning movable member is arranged in the seesaw contact position to position one end the seesaw-type rotary part. Then, when the motor has rotated the active rotation board, the rotational shaft of the seesaw-type rotary part moves in conjunction with the rotation of the active rotation board, and power is given to the latch from the other end of the seesaw-type rotary part. This makes it possible to rotationally drive the latch in a locking direction to bring the door into a fully closed state. Additionally, when the handle is operated, the positioning movable member is arranged in the seesaw release position, and the seesaw-type rotary part becomes freely rotatable with respect to the active rotation board. Thereby, when the power to the latch from the other end of seesaw-type rotary part is shut off, and the pawl is moved to the unlatched position, engaging between the latch and the striker is released, so that the door can be opened.

What is claimed is:

1. A vehicle door latch device comprising:

a latch which is attachable to a door of a vehicle and which is rotatable while engaging a striker provided in a vehicle body;

a pawl which is rotatable between a latched position where the pawl restricts a rotation of the latch to hold the door in a closed position and an unlatched position where the pawl permits the rotation of the latch;

a pawl biasing member which biases the pawl to the latched position;

a motor which starts rotating in response to operation of a door opening operating portion provided in the door, the rotation of the motor producing rotational power in either one direction of the motor or a different direction of the motor;

a release power transmitting unit operatively connected to the pawl and which transmits the rotational power in one direction of the motor to the pawl and rotates the pawl from the latched position to the unlatched position, wherein the pawl is rotationally driven from the latched position to the unlatched position by the rotational power of the motor in response to the operation of the door opening operating portion, thereby allowing the door to be opened, a motor-side rotation board, a relay rotation board, and a pawl-side rotation board which are provided in the release power transmitting unit, and which are rotatably supported about a common rotation board rotating pivot;

a pivot penetration long hole which is formed only in the relay rotation board among the three rotation boards, which allows the rotation board rotating pivot to pass therethrough, and which allows the relay rotation board to be linearly moved in a direction orthogonal to the rotation board rotating pivot;

a first canceling mechanism which in a state where the relay rotation board is arranged in a power transmission position at one end of a linear movable range thereof, connects the motor-side rotation board, the relay rotation board, and the pawl-side rotation board together to be rotatable integrally to one another, thereby allowing the rotational power in one direction of the motor to be transmitted in an order of the motor-side rotation board, the relay rotation board, the pawl-side rotation board and the pawl, and in a state where the relay rotation board is arranged in a power shutoff position at another end of the linear movable range, cancels the connecting, thereby allowing the motor-side rotation board and the pawl-side rotation board to be individually rotatable, and divides the transmission of power from the motor to the pawl, between the motor-side rotation board and the relay rotation board or between the relay rotation board and the pawl-side rotation board; and a cancel operating portion is arranged at a position which faces an operating hole for emergency formed in the door, and which causes the relay rotation board to move to the power shutoff position from the power transmission position by a manual operation to the cancel operating portion when the motor is stopped in a state where the pawl is disposed in the unlatched position.

2. The vehicle door latch device according to claim 1, wherein the cancel operating portion is arranged at a position which faces the operating hole for emergency formed at a position of the door sandwiched and hidden between the door and the vehicle body, and wherein the relay rotation board moves to the power shutoff position from the power transmission position by the cancel operating portion being pressed.

3. The vehicle door latch device according to claim 2, further comprising an operating force transmitting member which extends substantially in a horizontal direction, and which includes one end facing an outside of the door via the operating hole for emergency and another end rotatably connected with the relay rotation board, wherein the one end of the operating force transmitting member serves as the cancel operating portion, and wherein an intermediate portion of the operating force transmitting member is supported by an operating portion rotating pivot to be rotatable and linearly movable, the operating portion rotating pivot extending in parallel with the rotation board rotating pivot.

4. The vehicle door latch device according to claim 3, wherein a portion of the operating force transmitting member on a side of the cancel operating portion from the operating portion rotating pivot is shorter than a portion of the operating force transmitting member on a side of the relay rotation board from the operating portion rotating pivot.

5. The vehicle door latch device according to claim 3, wherein the first canceling mechanism includes:

a connecting rotation protrusion which is provided at a portion of the relay rotation board opposite to the operating force transmitting member with the rotation board rotating pivot therebetween, which protrudes in a direction parallel to the rotation board rotating pivot, which approaches the rotation board rotating pivot when the relay rotation board moves to the power transmission position, and which separates from the rotation board rotating pivot when the relay rotation board moves to the power shutoff position;

a protrusion engaging groove which is formed in the motor-side rotation board to receive the connecting rotation protrusion so as to be linearly movable in a direction in which the protrusion approaches and separates from the rotation board rotating pivot, which engages with a side surface of the connecting rotation protrusion in the whole linear movable range to connect the relay rotation board and the motor-side rotation board to be integrally rotatable;

a protrusion receiving recess which is formed in the pawl-side rotation board, which receives the connecting rotation protrusion to connect the relay rotation board and the pawl-side rotation board to be integrally rotatable when the connecting rotation protrusion is disposed at one end of the linear movable range on a side of the rotation board rotating pivot, and which allows the connecting rotation protrusion to separate from the protrusion receiving recess, so that the relay rotation board and the pawl-side rotation board becomes individually rotatable when the connecting rotation protrusion is disposed at another end of the linearly movable range apart from the rotation board rotating pivot; and a protrusion movement regulating portion which is formed in the pawl-side rotation board at a side of the protrusion receiving recess, which faces the connecting rotation protrusion separated from the protrusion receiving recess, from a side of the rotation board rotating pivot, and which regulates the connecting rotation protrusion approaching the rotation board rotating pivot.

6. The vehicle door latch device according to claim 5, further comprising:

a relay rotation board biasing member which biases the relay rotation board toward the power transmission position, and a motor-side rotation board biasing member which biases the motor-side rotation board in a direction opposite to a rotational direction by the rotational power in the one direction of the motor, wherein, when the motor stops in the unlatched position, and the relay rotation board is moved to the power shutoff position by the operation to the cancel operating portion, the pawl rotates to the latched position by the pawl biasing member, and in conjunction with the pawl, the pawl-side rotation board rotates and the connecting rotation protrusion is locked to the protrusion movement regulating portion, and wherein, when the motor recovers and rotates in the different direction, the different direction being opposite to the one direction, the motor-side rotation board is rotationally driven by the motor-side rotation board biasing member, the connecting rotation protrusion is received in the protrusion receiving recess, and the relay rotation board returns to the power transmission position.

7. The vehicle door latch device according to claim 3, wherein the cancel operating portion is arranged at a position which is capable of being pressed by a tool inserted through the operating hole for emergency.

8. The vehicle door latch device according to claim 1, further comprising an abnormality notifying unit which notifies abnormality in a case where the motor malfunctions in a state where the pawl is held in the unlatched position.

9. The vehicle door latch device according to claim 1, wherein the release power transmitting unit includes an active rotation board which is gear-connected with a rotation output shaft of the motor, and when being rotatably driven by the rotational power in the one direction of the motor, presses an end of the motor-side rotation board apart from a rotation center of the motor-side rotation board, thereby transmitting power to the motor-side rotation board, and wherein when the active rotation board is rotationally driven toward a side away from the motor-side rotation board by the rotational power in the different direction, the different direction being opposite to the one direction of the motor, the active rotation board is adapted to transmit the rotational power to the latch, thereby rotationally driving the latch in a locking direction in which the engagement with the striker is deepened, thereby causing the door to a fully-closed state.

10. The vehicle door latch device according to claim 9, further comprising a second canceling mechanism in a closing power transmitting unit which transmits power between the motor and the latch, wherein the second canceling mechanism includes:

a seesaw rotary part which is rotatably supported by the active rotation board at a position offset from a rotational shaft of the active rotation board; and a positioning movable member which is normally arranged in a seesaw contact position where one end of the seesaw rotary part is positioned, and moves to a seesaw release position where the positioning is released in conjunction with the operation of the door opening operating portion, wherein, when the positioning movable member is disposed in the seesaw contact position, a rotational shaft of the seesaw rotary part moves along with the rotation of the active rotation board where the one end of the seesaw rotary part is positioned, thereby providing power to the latch from another end of the seesaw rotary part, and wherein when the positioning movable member is disposed in the seesaw release position, the seesaw rotary part freely rotates with respect to the active rotation board, and shuts off the power to the latch.

* * * * *